US009804546B2

(12) United States Patent
Saito et al.

(10) Patent No.: US 9,804,546 B2
(45) Date of Patent: Oct. 31, 2017

(54) FIXING DEVICE AND IMAGE FORMING APPARATUS

(71) Applicants: Kazuya Saito, Kanagawa (JP); Yasunori Ishigaya, Kanagawa (JP); Yutaka Ikebuchi, Kanagawa (JP); Keitaro Shoji, Kanagawa (JP); Ryohei Matsuda, Kanagawa (JP)

(72) Inventors: Kazuya Saito, Kanagawa (JP); Yasunori Ishigaya, Kanagawa (JP); Yutaka Ikebuchi, Kanagawa (JP); Keitaro Shoji, Kanagawa (JP); Ryohei Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/202,859

(22) Filed: Jul. 6, 2016

(65) Prior Publication Data

US 2017/0017182 A1 Jan. 19, 2017

(30) Foreign Application Priority Data

Jul. 15, 2015 (JP) ..... 2015-141518
Mar. 15, 2016 (JP) ..... 2016-050881

(51) Int. Cl.
*G03G 15/20* (2006.01)

(52) U.S. Cl.
CPC ..... *G03G 15/2053* (2013.01); *G03G 15/2042* (2013.01)

(58) Field of Classification Search
None
See application file for complete search history.

(56) References Cited

U.S. PATENT DOCUMENTS

2011/0064437 A1 3/2011 Yamashina et al.
2011/0222929 A1 9/2011 Fujimoto et al.
2012/0008971 A1* 1/2012 Lee ..... G03G 15/2064 399/69
2012/0121305 A1 5/2012 Yoshikawa et al.
(Continued)

FOREIGN PATENT DOCUMENTS

JP 2002-258646 9/2002
JP 2011-191508 9/2011
(Continued)

*Primary Examiner* — Thomas Giampaolo, II
(74) *Attorney, Agent, or Firm* — Oblon, McClelland, Maier & Neustadt, L.L.P.

(57) ABSTRACT

A fixing device includes a primary heat generator and a secondary heat generator to heat an endless belt and a temperature detector, disposed opposite the secondary heat generator, to detect a temperature of the endless belt. The secondary heat generator includes an inboard edge and an outboard edge disposed outboard from the inboard edge in an axial direction of the endless belt. The secondary heat generator has an inboard length defined between a center of a detection span of the temperature detector and the inboard edge in the axial direction of the endless belt. The secondary heat generator further has an outboard length defined between the center of the detection span of the temperature detector and the outboard edge in the axial direction of the endless belt. The secondary heat generator defines a ratio of the outboard length to the inboard length that is greater than 7/3.

18 Claims, 13 Drawing Sheets

(56) References Cited

U.S. PATENT DOCUMENTS

| | | | | |
|---|---|---|---|---|
| 2013/0108300 | A1* | 5/2013 | Fujii | G03G 15/2042 399/69 |
| 2013/0195477 | A1 | 8/2013 | Seshita et al. | |
| 2013/0195524 | A1 | 8/2013 | Ishii et al. | |
| 2013/0202320 | A1 | 8/2013 | Hase et al. | |
| 2013/0202322 | A1 | 8/2013 | Waida et al. | |
| 2013/0209115 | A1 | 8/2013 | Hase et al. | |
| 2013/0209119 | A1 | 8/2013 | Yuasa et al. | |
| 2013/0209120 | A1 | 8/2013 | Namekata et al. | |
| 2013/0209121 | A1 | 8/2013 | Uchitani et al. | |
| 2013/0209124 | A1 | 8/2013 | Saito et al. | |
| 2013/0209125 | A1 | 8/2013 | Uchitani et al. | |
| 2013/0209128 | A1 | 8/2013 | Saito et al. | |
| 2013/0209131 | A1 | 8/2013 | Uchitani et al. | |
| 2014/0079453 | A1 | 3/2014 | Arai et al. | |
| 2014/0079455 | A1 | 3/2014 | Seki et al. | |
| 2014/0133877 | A1 | 5/2014 | Samei et al. | |
| 2014/0199100 | A1* | 7/2014 | Seol | G03G 15/2053 399/329 |
| 2014/0270820 | A1 | 9/2014 | Saito et al. | |
| 2014/0270831 | A1 | 9/2014 | Yoshinaga et al. | |
| 2014/0270832 | A1 | 9/2014 | Saito et al. | |
| 2014/0270872 | A1 | 9/2014 | Tamaki et al. | |
| 2014/0341627 | A1 | 11/2014 | Yoshikawa et al. | |
| 2014/0356036 | A1 | 12/2014 | Shimokawa et al. | |
| 2014/0356037 | A1 | 12/2014 | Shimokawa et al. | |
| 2014/0356038 | A1 | 12/2014 | Arai et al. | |
| 2015/0050046 | A1 | 2/2015 | Honda et al. | |
| 2015/0055993 | A1 | 2/2015 | Shoji | |
| 2015/0104227 | A1 | 4/2015 | Shimokawa et al. | |
| 2015/0104230 | A1 | 4/2015 | Uchitani et al. | |
| 2015/0110531 | A1 | 4/2015 | Takagi et al. | |
| 2015/0125193 | A1 | 5/2015 | Ishii et al. | |
| 2015/0177659 | A1 | 6/2015 | Ishigaya et al. | |
| 2015/0185671 | A1 | 7/2015 | Ikebuchi et al. | |
| 2015/0212459 | A1 | 7/2015 | Hase et al. | |
| 2015/0227095 | A1 | 8/2015 | Uchitani et al. | |
| 2015/0261151 | A1 | 9/2015 | Ishigaya et al. | |
| 2015/0261157 | A1 | 9/2015 | Yamano et al. | |
| 2015/0268597 | A1 | 9/2015 | Arai et al. | |
| 2016/0033910 | A1 | 2/2016 | Shimokawa et al. | |
| 2016/0116869 | A1 | 4/2016 | Saito et al. | |
| 2016/0154350 | A1 | 6/2016 | Saito et al. | |

FOREIGN PATENT DOCUMENTS

| | | |
|---|---|---|
| JP | 2012-103608 | 5/2012 |
| JP | 2012-230293 | 11/2012 |
| JP | 2013-152397 | 8/2013 |
| JP | 2014-085430 | 5/2014 |
| JP | 2015-064560 | 4/2015 |
| JP | 2015-102718 | 6/2015 |
| JP | 2015-145950 | 8/2015 |
| JP | 2015-194661 | 11/2015 |
| JP | 2016-009049 | 1/2016 |
| JP | 2016-014860 | 1/2016 |
| JP | 2016-018062 | 2/2016 |
| JP | 2016-095454 | 5/2016 |

* cited by examiner

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2015-141518, filed on Jul. 15, 2015, and 2016-050881, filed on Mar. 15, 2016, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

This specification describes below an improved fixing device. In one exemplary embodiment, the fixing device includes an endless belt rotatable in a predetermined direction of rotation and a nip formation pad disposed opposite an inner circumferential surface of the endless belt. The nip formation pad includes a base and an increased thermal conductivity conductor being interposed between the base and the endless belt and having a thermal conductivity greater than a thermal conductivity of the base. An opposed rotator presses against the nip formation pad via the endless belt to form a fixing nip between the endless belt and the opposed rotator, through which a recording medium bearing a toner image is conveyed. A primary heat generator is disposed opposite the endless belt. A secondary heat generator is disposed opposite the endless belt and disposed outboard from the primary heat generator in an axial direction of the endless belt. A temperature detector, disposed opposite the secondary heat generator, detects a temperature of the endless belt. The temperature detector has a detection span in the axial direction of the endless belt. The secondary heat generator includes an inboard edge and an outboard edge disposed outboard from the inboard edge in the axial direction of the endless belt. The secondary heat generator has an inboard length defined between a center of the detection span of the temperature detector and the inboard edge in the axial direction of the endless belt. The secondary heat generator further has an outboard length defined between the center of the detection span of the temperature detector and the outboard edge in the axial direction of the endless belt. The secondary heat generator defines a ratio of the outboard length to the inboard length that is greater than 7/3.

This specification further describes an improved fixing device. In one exemplary embodiment, the fixing device includes an endless belt rotatable in a predetermined direction of rotation and a nip formation pad disposed opposite an inner circumferential surface of the endless belt. The nip formation pad includes a base and an increased thermal conductivity conductor being interposed between the base and the endless belt and having a thermal conductivity greater than a thermal conductivity of the base. An opposed rotator presses against the nip formation pad via the endless belt to form a fixing nip between the endless belt and the opposed rotator, through which a recording medium bearing a toner image is conveyed. A primary heat generator is disposed opposite the endless belt. A secondary heat generator is disposed opposite the endless belt and disposed outboard from the primary heat generator in an axial direction of the endless belt. A temperature detector, disposed opposite the secondary heat generator, detects a temperature of the endless belt. The secondary heat generator includes an inboard edge and an outboard edge disposed outboard from the inboard edge in the axial direction of the endless belt. The secondary heat generator has an inboard length defined between a center of the temperature detector and the inboard edge in the axial direction of the endless belt. The secondary heat generator further has an outboard length defined between the center of the temperature detector and the outboard edge in the axial direction of the endless belt. The secondary heat generator defines a ratio of the outboard length to the inboard length that is greater than 7/3.

This specification further describes an improved image forming apparatus. In one exemplary embodiment, the image forming apparatus includes an image forming device to form a toner image and a fixing device, disposed downstream from the image forming device in a recording medium conveyance direction, to fix the toner image on a recording medium. The fixing device includes an endless belt rotatable in a predetermined direction of rotation and a nip formation pad disposed opposite an inner circumferential surface of the endless belt. The nip formation pad includes a base and an increased thermal conductivity conductor being interposed between the base and the endless belt and having a thermal conductivity greater than a thermal conductivity of the base. An opposed rotator presses against the nip formation pad via the endless belt to form a fixing nip between the endless belt and the opposed rotator, through which the recording medium bearing the toner image is conveyed. A primary heat generator is disposed opposite the endless belt. A secondary heat generator is disposed opposite the endless belt and disposed outboard from the primary heat generator in an axial direction of the endless belt. A temperature detector, disposed opposite the secondary heat generator, detects a temperature of the endless belt. The temperature detector has a detection span in the axial direction of the endless belt. The secondary heat generator includes an inboard edge and an outboard edge disposed outboard from the inboard edge in the axial direction of the endless belt. The secondary heat generator has an inboard length defined between a center of the detection span of the temperature detector and the inboard edge in the axial direction of the endless belt. The secondary heat generator further has an outboard length defined between the center of the detection span of the temperature detector and the outboard edge in the axial direction of the endless belt. The secondary heat generator defines a ratio of the outboard length to the inboard length that is greater than 7/3.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
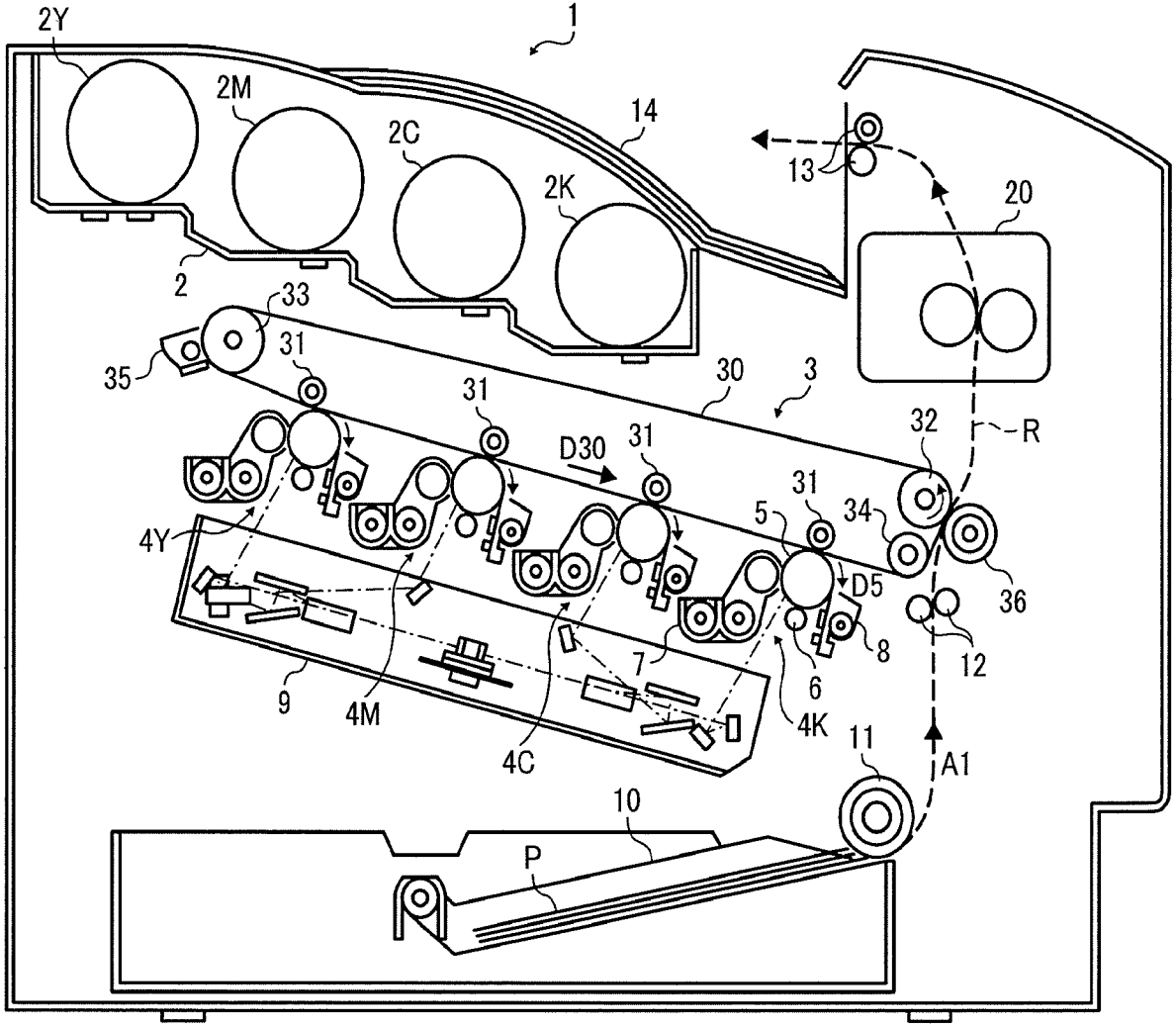
FIG. 1 is a schematic vertical cross-sectional view of an image foil ling apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms a color toner image on a recording medium by electrophotography. Alternatively, the image forming apparatus 1 may be a monochrome printer that forms a monochrome toner image on a recording medium.

It is to be noted that, in the drawings for explaining exemplary embodiments of this disclosure, identical reference numerals are assigned as long as discrimination is possible to components such as members and component parts having an identical function or shape, thus omitting description thereof once it is provided.

Referring to FIG. 1, a description is provided of a construction of the image forming apparatus 1.

As illustrated in FIG. 1, the image forming apparatus 1 is a color laser printer including four image forming devices 4Y, 4M, 4C, and 4K situated in a center portion thereof. Although the image forming devices 4Y, 4M, 4C, and 4K contain developers (e.g., yellow, magenta, cyan, and black toners) in different colors, that is, yellow, magenta, cyan, and black corresponding to color separation components of a color image, respectively, they have an identical structure.

For example, each of the image forming devices 4Y, 4M, 4C, and 4K includes a drum-shaped photoconductor 5 serving as an image bearer or a latent image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are coupled to a power supply that applies a predetermined direct current (DC) voltage and/or a predetermined alternating current (AC) voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is coupled to the power supply that applies a predetermined DC voltage and/or a predetermined AC voltage thereto.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction A1. The registration roller pair 12 serving as a timing roller pair conveys the sheet P conveyed from the feed roller 11 toward the secondary transfer nip at a proper time.

The conveyance path R is further provided with a fixing device 20 (e.g., a fuser or a fusing unit) located above the secondary transfer nip, that is, downstream from the secondary transfer nip in the sheet conveyance direction A1. The fixing device 20 fixes an unfixed toner image transferred from the intermediate transfer belt 30 onto the sheet P conveyed from the secondary transfer nip on the sheet P. The conveyance path R is further provided with the output roller pair 13 located above the fixing device 20, that is, downstream from the fixing device 20 in the sheet conveyance direction A1. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

Referring to FIG. 1, a description is provided of an image forming operation performed by the image forming apparatus 1 having the construction described above to form a full color toner image on a sheet P.

As a print job starts, a driver drives and rotates the photoconductors 5 of the image forming devices 4Y, 4M, 4C, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constituting color image data sent from the external device, respectively, thus forming electrostatic latent images thereon. The image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the photoconductors 5, visualizing the electrostatic latent images as yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at the respective primary transfer nips formed between the photoconductors 5 and the primary transfer rollers 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a full color toner image is formed on an outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively.

On the other hand, the feed roller 11 disposed in the lower portion of the image forming apparatus 1 is driven and rotated to feed a sheet P from the paper tray 10 toward the registration roller pair 12 in the conveyance path R. The registration roller pair 12 halts the sheet P temporarily.

Thereafter, the registration roller pair 12 resumes rotation at a predetermined time to convey the sheet P to the secondary transfer nip at a time when the full color toner image formed on intermediate transfer belt 30 reaches the secondary transfer nip. The secondary transfer roller 36 is applied with a transfer voltage having a polarity opposite a polarity of the charged yellow, magenta, cyan, and black toners constituting the full color toner image formed on the intermediate transfer belt 30, thus creating a transfer electric field at the secondary transfer nip. Thus, the yellow, magenta, cyan, and black toner images constituting the full color toner image are secondarily transferred from the intermediate transfer belt 30 onto the sheet P collectively by the transfer electric field created at the secondary transfer nip. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom.

Thereafter, the sheet P bearing the full color toner image is conveyed to the fixing device 20 that fixes the full color toner image on the sheet P. Then, the sheet P bearing the fixed full color toner image is ejected by the output roller pair 13 onto the outside of the image forming apparatus 1, that is, the output tray 14 that stocks the sheet P.

The above describes the image forming operation of the image forming apparatus 1 to form the full color toner image on the sheet P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
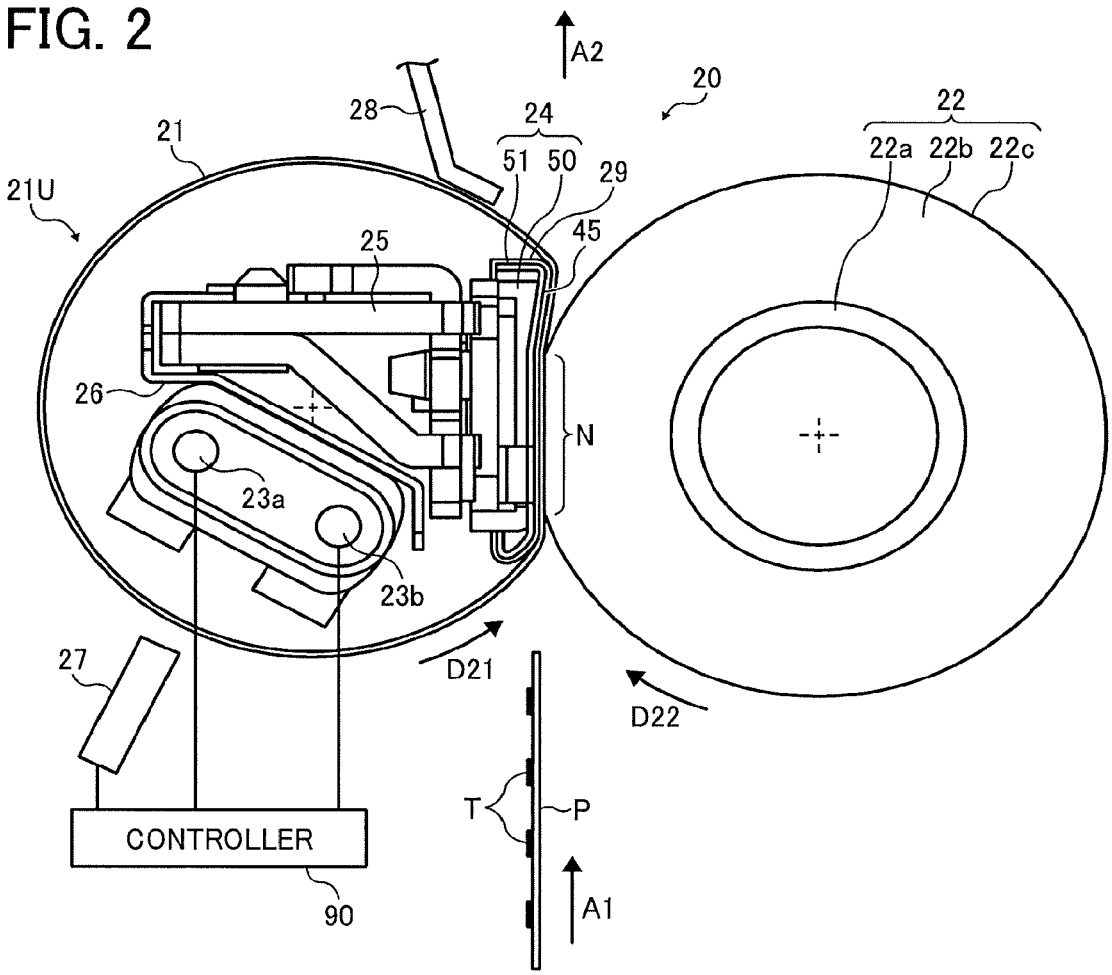
FIG. 2 is a schematic vertical cross-sectional view of a fixing device incorporated in the image forming apparatus depicted in FIG. 1.

Referring to FIG. 2, a description is provided of a construction of the fixing device 20 incorporated in the image forming apparatus 1 having the construction described above.

FIG. 2 is a schematic vertical cross-sectional view of the fixing device 20. As illustrated in FIG. 2, the fixing device 20 includes a fixing belt 21, a pressure roller 22, two heaters, that is, a lateral end heater 23*a* and a center heater 23*b*, a nip formation pad 24, a stay 25, a reflector 26, a temperature sensor 27, and a separator 28. The fixing belt 21 formed into a loop serves as a fixing rotator or an endless belt rotatable in a rotation direction D21. The pressure roller 22 serves as an opposed rotator that is rotatable in a rotation direction D22 and disposed opposite the fixing belt 21. The lateral end heater 23*a* and the center heater 23*b* serve as a heater or a heat source that heats the fixing belt 21. The nip formation pad 24 presses against the pressure roller 22 via the fixing belt 21 to form a fixing nip N between the fixing belt 21 and the pressure roller 22. The stay 25 serves as a support that supports the nip formation pad 24. The reflector 26 reflects light or heat radiated from the lateral end heater 23*a* and the center heater 23*b* to the fixing belt 21. The temperature sensor 27 serves as a temperature detector that detects the temperature of an outer circumferential surface of the fixing belt 21. The separator 28 separates the sheet P having passed through the fixing nip N from the fixing belt 21. The fixing belt 21 and the components disposed inside the loop formed by the fixing belt 21, that is, the lateral end heater 23*a*, the center heater 23*b*, the nip formation pad 24, the stay 25, and the reflector 26, may constitute a belt unit 21U separably coupled with the pressure roller 22.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluoro rubber may be interposed between the base layer and the release layer.

A detailed description is now given of a construction of the pressure roller 22.

The pressure roller 22 is constructed of a cored bar 22*a*; an elastic layer 22*b* coating the cored bar 22*a* and made of silicone rubber foam, silicone rubber, fluoro rubber, or the like; and a release layer 22*c* coating the elastic layer 22*b* and made of PFA, PTFE, or the like. A pressurization assembly including a spring presses the pressure roller 22 against the nip formation pad 24 via the fixing belt 21. The pressure roller 22 pressingly contacting the fixing belt 21 deforms the elastic layer 22*b* of the pressure roller 22 at the fixing nip N formed between the pressure roller 22 and the fixing belt 21, thus defining the fixing nip N having a predetermined length in the sheet conveyance direction A1. A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 by friction between the pressure roller 22 and the fixing belt 21. Alternatively, the driver may also be connected to the fixing belt 21 to drive and rotate the fixing belt 21.

According to this exemplary embodiment, the pressure roller 22 is a solid roller. Alternatively, the pressure roller 22 may be a hollow roller. In this case, a heater may be disposed inside the hollow roller. If the pressure roller 22 does not incorporate the elastic layer 22*b*, the pressure roller 22 has a decreased thermal capacity that improves fixing property of being heated quickly to a predetermined fixing temperature at which a toner image T is fixed on a sheet P properly. However, as the pressure roller 22 and the fixing belt 21 sandwich and press the unfixed toner image T on the sheet P passing through the fixing nip N, slight surface asperities of the fixing belt 21 may be transferred onto the toner image T on the sheet P, resulting in variation in gloss of the solid toner image T. To address this circumstance, it is preferable that the pressure roller 22 incorporates the elastic layer 22*b* having a thickness not smaller than 100 micrometers. The elastic layer 22*b* having the thickness not smaller than 100 micrometers elastically deforms to absorb slight surface asperities of the fixing belt 21, preventing variation in gloss of the toner image T on the sheet P. The elastic layer 22*b* may be made of solid rubber. Alternatively, if no heater is situated inside the pressure roller 22, the elastic layer 22*b* may be made of sponge rubber. The sponge rubber is more preferable than the solid rubber because the sponge rubber has an increased insulation that draws less heat from the fixing belt 21. According to this exemplary embodiment, the pressure roller 22 is pressed against the fixing belt 21. Alternatively, the pressure roller 22 may merely contact the fixing belt 21 with no pressure therebetween.

A detailed description is now given of a configuration of the lateral end heater 23*a* and the center heater 23*b*.

The two heaters, that is, the lateral end heater 23*a* and the center heater 23*b*, are situated inside the loop formed by the fixing belt 21. Both lateral ends of each of the lateral end heater 23*a* and the center heater 23*b* in a longitudinal direction thereof parallel to an axial direction of the fixing belt 21 are mounted on or secured to side plates of the fixing device 20, respectively. For example, the fixing device 20 employs a direct heating method in which the lateral end heater 23*a* and the center heater 23*b* heat the fixing belt 21 directly. The direct heating method heats the fixing belt 21 effectively, saving energy and shortening a warm-up time or the like to warm up the fixing belt 21 to a target temperature. A controller 90 (e.g., a processor), that is, a central processing unit (CPU) provided with a random-access memory (RAM) and a read-only memory (ROM), for example, operatively connected to the temperature sensor 27, the lateral end heater 23*a*, and the center heater 23*b* controls output of each of the lateral end heater 23*a* and the center heater 23*b* based on the temperature of the outer circumferential surface of the fixing belt 21 detected by the temperature sensor 27. The controller 90 may be disposed inside the fixing device 20 or the image forming apparatus 1. Thus, the temperature of the fixing belt 21 is adjusted to a desired fixing temperature. The temperature sensor 27 may be a thermopile, a thermostat, a thermistor, a non-contact (NC) sensor, or the like that detects the temperature.

A detailed description is now given of a construction of the nip formation pad 24. The nip formation pad 24 is disposed inside the loop formed by the fixing belt 21 and disposed opposite the pressure roller 22 via the fixing belt 21. The nip formation pad 24 is an elongate pad extending continuously in the axial direction of the fixing belt 21. As the pressure roller 22 is pressed against the nip formation pad 24 via the fixing belt 21, the nip formation pad 24 produces the fixing nip N extending continuously in the axial direction of the fixing belt 21. The nip formation pad 24 is secured to and supported by the stay 25. Accordingly, even if the nip formation pad 24 receives pressure from the pressure roller 22, the nip formation pad 24 is not bent by the pressure and therefore produces a uniform nip length in the sheet conveyance direction A1 throughout the entire width of the pressure roller 22 in an axial direction thereof.

The nip formation pad 24 is coated with a low-friction sheet 29 mounted on an opposed face of the nip formation pad 24 that is disposed opposite the fixing belt 21. Thus, the low-friction sheet 29 is sandwiched between the nip formation pad 24 and the fixing belt 21. As the fixing belt 21 rotates in the rotation direction D21, the fixing belt 21 slides over the low-friction sheet 29 that reduces a driving torque developed between the fixing belt 21 and the nip formation pad 24, reducing load exerted to the fixing belt 21 by friction between the fixing belt 21 and the nip formation pad 24. A bulge 45 projects from a downstream end of the nip formation pad 24 that is in proximity to an exit of the fixing nip N toward the pressure roller 22. The bulge 45 does not press against the pressure roller 22 via the fixing belt 21 and therefore is not produced by contact with the pressure roller 22. The bulge 45 lifts the sheet P conveyed through the exit of the fixing nip N from the fixing belt 21, facilitating separation of the sheet P from the fixing belt 21.

The nip formation pad 24 is made of a heat resistant material resistant against temperatures not lower than 200 degrees centigrade. For example, the nip formation pad 24 is made of general heat resistant resin such as polyether sulfone (PES), polyphenylene sulfide (PPS), liquid crystal polymer (LCP), polyether nitrile (PEN), polyamide imide (PAI), and polyether ether ketone (PEEK). Thus, the nip formation pad 24 made of the heat resistant resin is immune from thermal deformation at temperatures in a fixing temperature range desirable to fix the toner image T on the sheet P, retaining the shape of the fixing nip N and quality of the toner image T formed on the sheet P.

A detailed description is now given of a configuration of the stay 25.

The stay 25 is disposed inside the loop formed by the fixing belt 21. Both lateral ends of the stay 25 in a longitudinal direction thereof parallel to the axial direction of the fixing belt 21 are mounted on or secured to the side plates of the fixing device 20, respectively. The stay 25 is made of metal having an increased mechanical strength, such as stainless steel and iron, to prevent bending of the nip formation pad 24. Alternatively, the stay 25 may be made of resin that attains a desired mechanical strength of the stay 25.

A detailed description is now given of a configuration of the reflector 26.

The reflector 26 is interposed between the stay 25 and the two heaters (e.g., the lateral end heater 23*a* and the center heater 23*b*). The reflector 26 is secured to or mounted on the stay 25, thus being supported by the stay 25. The reflector 26 interposed between the stay 25 and the two heaters (e.g., the lateral end heater 23*a* and the center heater 23*b*) reflects light or heat radiated from the lateral end heater 23*a* and the center heater 23*b* to the stay 25 toward the fixing belt 21, heating the fixing belt 21 effectively. The reflector 26 suppresses conduction of heat from the lateral end heater 23*a* and the center heater 23*b* to the stay 25 and the like, saving energy. Since the reflector 26 is heated by the lateral end heater 23*a* and the center heater 23*b* directly, the reflector 26 is made of metal having an increased melting point or the like. Alternatively, instead of installation of the reflector 26, an opposed face of the stay 25 that is disposed opposite the lateral end heater 23*a* and the center heater 23*b* may be treated with polishing or mirror finishing such as coating to produce a reflection face that reflects light or heat radiated from the lateral end heater 23*a* and the center heater 23*b* toward the fixing belt 21. For example, the reflector 26 or the reflection face of the stay 25 has a reflection rate of 90 percent or more.

In order to decrease the thermal capacity of the fixing belt 21, the fixing belt 21 is thin and has a decreased loop diameter. For example, the fixing belt 21 is constructed of the base layer having a thickness in a range of from 20 micrometers to 50 micrometers; the elastic layer having a thickness in a range of from 100 micrometers to 300 micrometers; and the release layer having a thickness in a range of from 10 micrometers to 50 micrometers. Thus, the fixing belt 21 has a total thickness not greater than 1 mm. A loop diameter of the fixing belt 21 is in a range of from 20 mm to 40 mm. In order to decrease the thermal capacity of the fixing belt 21 further, the fixing belt 21 may have a total thickness not greater than 0.20 mm and preferably not greater than 0.16 mm. Additionally, the loop diameter of the fixing belt 21 may not be greater than 30 mm.

According to this exemplary embodiment, the pressure roller 22 has a diameter in a range of from 20 mm to 40 mm. Hence, the loop diameter of the fixing belt 21 is equivalent to the diameter of the pressure roller 22. Alternatively, the loop diameter of the fixing belt 21 may be smaller than the diameter of the pressure roller 22. In this case, a curvature of the fixing belt 21 at the fixing nip N is greater than that of the pressure roller 22, facilitating separation of the sheet P ejected from the fixing nip N from the fixing belt 21.

A description is provided of a fixing operation performed by the fixing device 20 having the construction described above.

As the image forming apparatus 1 is powered on, the lateral end heater 23*a* and the center heater 23*b* are supplied with power and the driver starts driving and rotating the pressure roller 22 in the rotation direction D22, which in turn rotates the fixing belt 21 in the rotation direction D21. When the fixing belt 21 attains the target temperature, the feed roller 11 depicted in FIG. 1 picks up and feeds a sheet P from the paper tray 10 to the registration roller pair 12 that conveys the sheet P to the secondary transfer nip where an unfixed toner image T is secondarily transferred from the intermediate transfer belt 30 onto the sheet P. As illustrated in FIG. 2, the sheet P bearing the unfixed toner image T is conveyed in the sheet conveyance direction A1 and enters the fixing nip N formed between the fixing belt 21 and the pressure roller 22 pressed against the fixing belt 21. The toner image T is fixed on the sheet P under heat from the fixing belt 21 heated by the lateral end heater 23*a* and the center heater 23*b* and pressure exerted from the pressure roller 22. The sheet P is ejected from the fixing nip N, separated from the fixing belt 21 by the separator 28, and conveyed in a sheet conveyance direction A2.

A description is provided of a construction of the lateral end heater 23*a* and the center heater 23*b* in detail.

Figure 3:
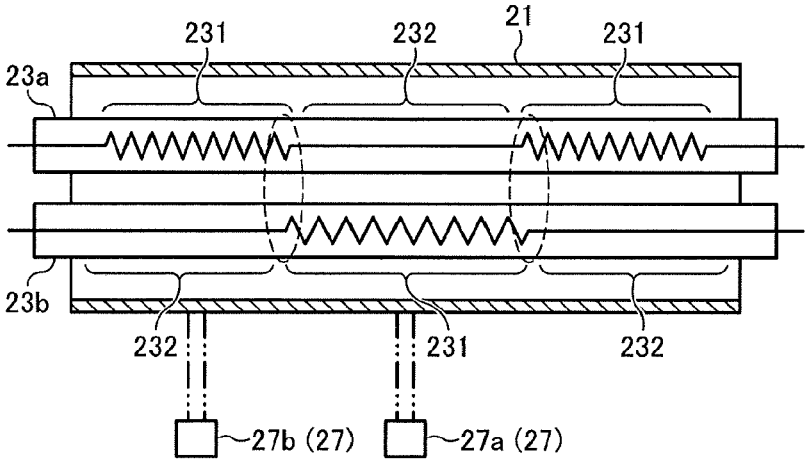
FIG. 3 is a plan view of a lateral end heater and a center heater incorporated in the fixing device depicted in FIG. 2.

FIG. 3 is a plan view of the lateral end heater 23*a* and the center heater 23*b*. As illustrated in FIG. 3, each of the lateral end heater 23*a* and the center heater 23*b* includes a heat generator 231. The heat generator 231 of the lateral end heater 23*a* is disposed outboard from the heat generator 231 of the center heater 23*b* in the longitudinal direction of the lateral end heater 23*a* and the center heater 23*b* parallel to a width direction of the sheet P. As illustrated in FIG. 2, the center heater 23*b* serving as a primary heater is disposed downstream from the lateral end heater 23*a* serving as a secondary heater in the rotation direction D21 of the fixing belt 21. As illustrated in FIG. 3, the center heater 23*b* mainly heats a center span of the fixing belt 21 in the axial direction thereof. The center heater 23*b* includes the heat generator 231 disposed at a center span of the center heater 23*b* in the longitudinal direction thereof that is disposed opposite the center span of the fixing belt 21 in the axial direction thereof. Conversely, as illustrated in FIG. 2, the lateral end heater 23*a* is disposed upstream from the center heater 23*b* in the rotation direction D21 of the fixing belt 21. As illustrated in FIG. 3, the lateral end heater 23*a* mainly heats each lateral end span of the fixing belt 21 in the axial direction thereof. The lateral end heater 23*a* includes the heat generator 231 disposed at each lateral end span of the lateral end heater 23*a* in the longitudinal direction thereof that is disposed opposite each lateral end span of the fixing belt 21 in the axial direction thereof.

A portion of each of the lateral end heater 23*a* and the center heater 23*b* that is other than the heat generator 231 is a non-heat generator 232 that barely generates heat. The heat generator 231 of the lateral end heater 23*a* is disposed opposite the non-heat generator 232 of the center heater 23*b*. The non-heat generator 232 of the lateral end heater 23*a* is disposed opposite the heat generator 231 of the center heater 23*b*.

When a small sheet P having a width not greater than a width of the heat generator 231 of the center heater 23*b* in the longitudinal direction thereof is conveyed through the fixing device 20, the controller 90 depicted in FIG. 2 controls the center heater 23*b* to generate heat mainly. Accordingly, the center heater 23*b* heats the center span of the fixing belt 21 in the axial direction thereof, allowing the fixing belt 21 to fix the toner image T on the small sheet P conveyed over the center span of the fixing belt 21. The lateral end heater 23*a* generates heat slightly to prevent temperature decrease at each lateral end of the heat generator 231 of the center heater 23*b* in the longitudinal direction thereof. However, the controller 90 does not control heat generation of the lateral end heater 23*a* precisely because the controller 90 controls the lateral end heater 23*a* to prevent temperature decrease at each lateral end of the heat generator 231 of the center heater 23*b* in the longitudinal direction thereof, not to fix the toner image T on the sheet P. Conversely, when a large sheet P having a width greater than the width of the heat generator 231 of the center heater 23*b* in the longitudinal direction thereof is conveyed through the fixing device 20, the controller 90 controls both the lateral end heater 23*a* and the center heater 23*b* to generate heat. In this case, the controller 90 controls heat generation of the lateral end heater 23*a* precisely. Accordingly, the lateral end heater 23*a* and the center heater 23*b* heat an increased span spanning from the center span to each lateral end span of the fixing belt 21 in the axial direction thereof, allowing the fixing belt 21 to fix the toner image T on the large sheet P conveyed over the center span and each lateral end span of the fixing belt 21.

As illustrated in FIG. 3, the temperature sensor 27 includes a center sensor 27*a* serving as a first temperature detector and a lateral end sensor 27*b* serving as a second temperature detector. The center sensor 27*a* is disposed opposite the center span of the fixing belt 21 in the axial direction thereof and the heat generator 231 of the center heater 23*b*. The lateral end sensor 27*b* is disposed opposite one lateral end span of the fixing belt 21 in the axial direction thereof and the heat generator 231 of the lateral end heater 23*a*. The center sensor 27*a* detects the temperature of the center span of the fixing belt 21 in the axial direction thereof. The lateral end sensor 27*b* detects the temperature of the lateral end span of the fixing belt 21 in the axial direction thereof separately from the center sensor 27*a*. The controller 90 controls the center heater 23*b* and the lateral end heater 23*a* based on the temperatures of the fixing belt 21 detected by the center sensor 27*a* and the lateral end sensor 27*b*, respectively, thus retaining the temperature of the fixing belt 21 in a predetermined temperature range.

Figure 4:
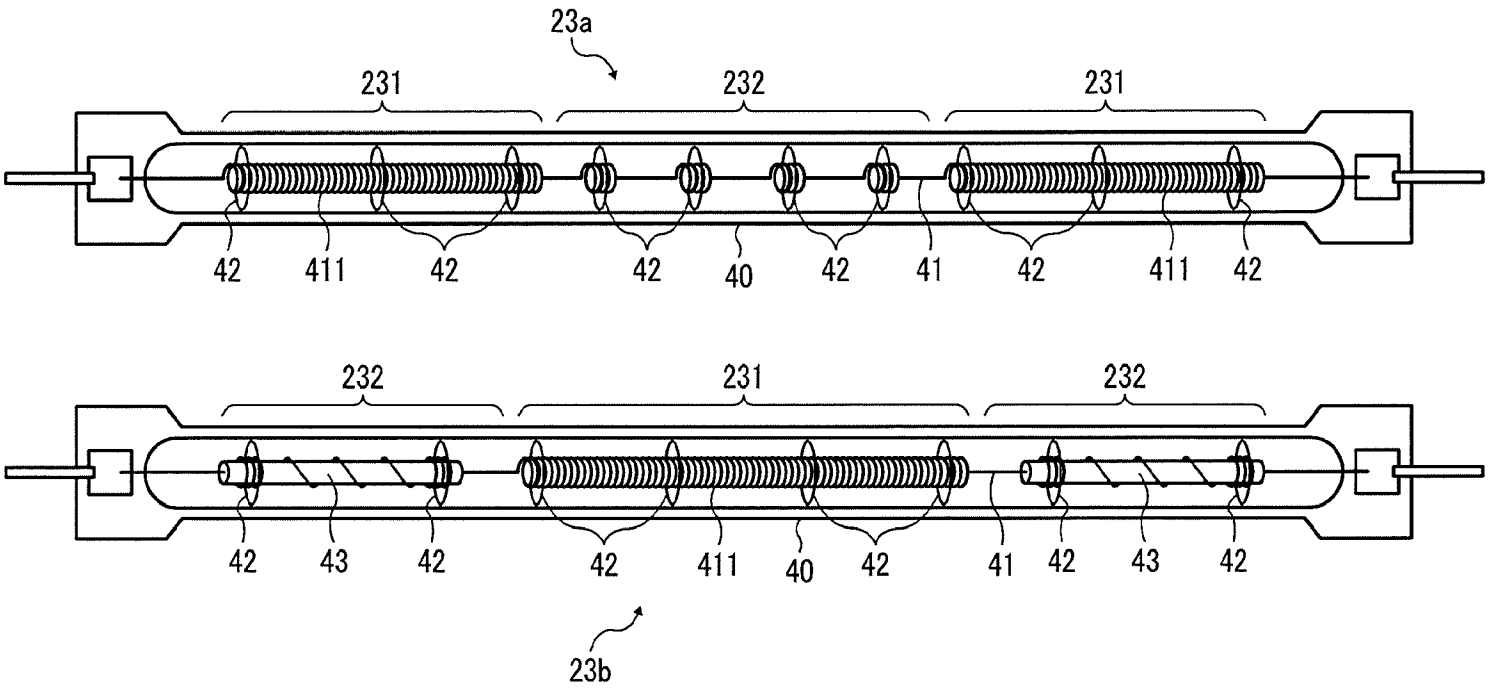
FIG. 4 is a perspective view of the lateral end heater and the center heater depicted in FIG. 3.

FIG. 4 is a perspective view of the lateral end heater 23*a* and the center heater 23*b*. As illustrated in FIG. 4, each of the lateral end heater 23*a* and the center heater 23*b* is a filament lamp including a tubular glass tube 40 made of quartz glass or the like and a filament 41 made of tungsten or the like. The filament 41 is disposed inside the glass tube 40. According to this exemplary embodiment, the lateral end heater 23*a* and the center heater 23*b* employ filament lamps having different properties, respectively.

For example, the lateral end heater 23*a* includes a heat generation portion 411 (e.g., a luminous portion) where the filament 41 is coiled helically and densely. The heat generation portion 411 spans the entire width of the heat generator 231 in the longitudinal direction of the lateral end heater 23*a*. Conversely, the filament 41 is substantially straight in the non-heat generator 232 of the lateral end heater 23*a*. However, the non-heat generator 232 partially includes a plurality of dense coil portions where the filament 41 is coiled densely. The dense coil portion of the non-heat generator 232 is also called a dead coil and supported by a ring supporter 42 so that the filament 41 retains a desired shape. The supporter 42 is made of tungsten or the like and also situated in the heat generator 231.

Like the lateral end heater 23*a*, the center heater 23*b* includes the heat generation portion 411 (e.g., the luminous portion) where the filament 41 is coiled helically and densely. The heat generation portion 411 spans the entire width of the heat generator 231 in the longitudinal direction of the center heater 23*b*. The heat generation portion 411 is partially supported by the supporters 42. Conversely, the non-heat generator 232 of the center heater 23*b* is different in construction from the non-heat generator 232 of the lateral end heater 23*a*. The non-heat generator 232 of the center heater 23*b* includes a cored bar 43 addressing short circuit that is made of metal such as molybdenum. The filament 41 is coiled around the cored bar 43. The non-heat generator 232 partially includes a plurality of dense coil portions where the filament 41 is coiled densely. The dense coil portions are supported by the supporters 42, respectively.

As described above, the center heater 23*b* is substantially different from the lateral end heater 23*a* in that the non-heat generator 232 of the center heater 23*b* includes the cored bar 43. The cored bar 43 disposed in the non-heat generator 232 suppresses heat generation from the dense coil portions of the filament 41 in the non-heat generator 232. For example, the cored bar 43 decreases the electric resistance of the dense coil portions of the filament 41 in the non-heat generator 232 of the center heater 23*b*, suppressing heat generation compared to heat generation from the dense coil portions (e.g., the dead coils) of the lateral end heater 23*a*.

As described above, according to this exemplary embodiment, the cored bar 43 of the center heater 23*b* suppresses local heat generation from each lateral end span of the center heater 23*b* in the longitudinal direction thereof. Accordingly, variation in the temperature of the fixing belt 21 is reduced, improving control of the temperature of the fixing belt 21. Additionally, the center heater 23*b* suppresses redundant heat generation in the non-heat generator 232, decreasing power consumption of the center heater 23*b*. Even if the center heater 23*b* shares a common power supply with a lamp, a lighting, or the like, the center heater 23*b* is immune from flicker. In addition to increased power consumption, a shortened control cycle (e.g., a shortened energization cycle) of the center heater 23*b* causes the center heater 23*b* to be susceptible to flicker. According to this exemplary embodiment, decreased power consumption of the center heater 23*b* shortens the control cycle of the center heater 23*b*, improving control of the temperature of the fixing belt 21.

Figure 5A:
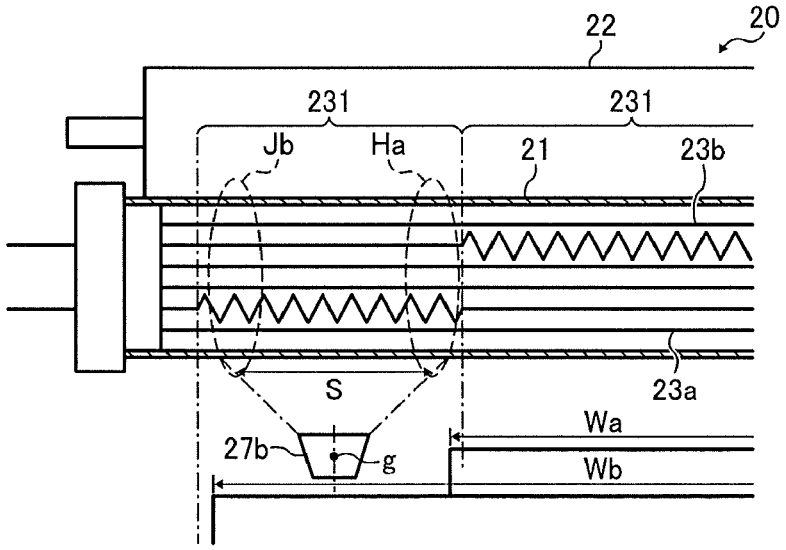
FIG. 5A is a partial cross-sectional view of the fixing device depicted in FIG. 2, illustrating a lateral end sensor.
Figure 5B:
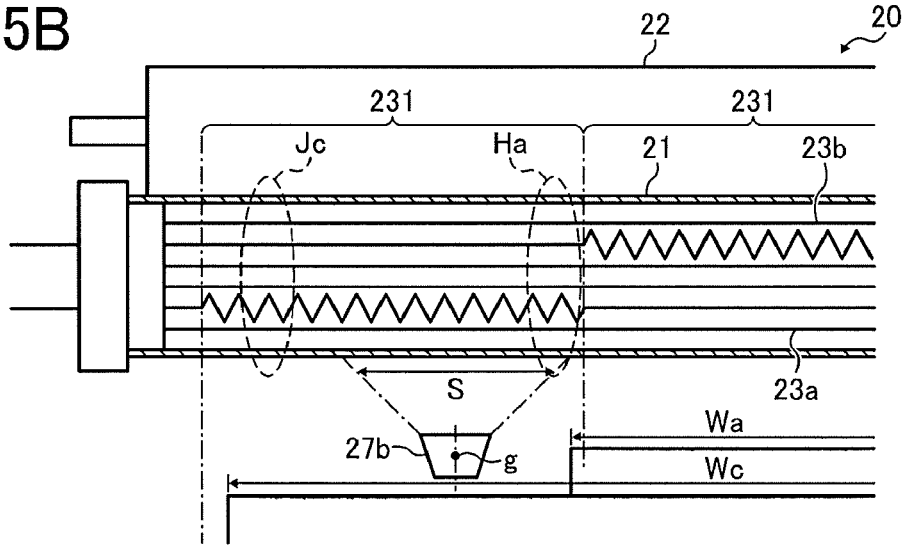
FIG. 5B is a partial cross-sectional view of the fixing device depicted in FIG. 2, illustrating an increased conveyance span where a sheet is conveyed.
Figure 5C:
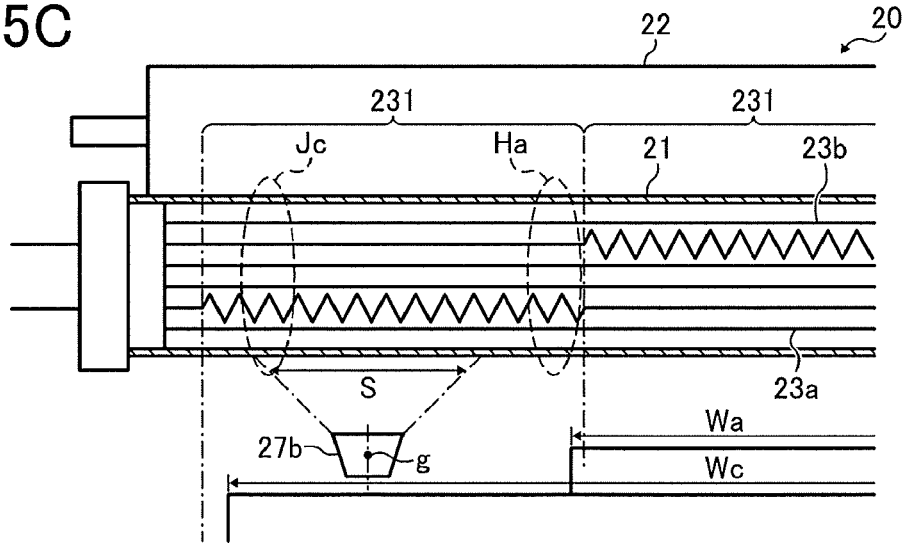
FIG. 5C is a partial cross-sectional view of the fixing device depicted in FIG. 2, illustrating the increased conveyance span depicted in FIG. 5B and the lateral end sensor disposed at a position outboard from a position of the lateral end sensor depicted in FIG. 5A.

Referring to FIGS. 5A, 5B, and 5C, a description is provided of location of the lateral end sensor 27*b* and disadvantages.

FIG. 5A is a partial cross-sectional view of the fixing device 20. The lateral end sensor 27*b* is installed in the fixing device 20 for two purposes. A first purpose is that the lateral end sensor 27*b* detects temperature increase or overheating of the fixing belt 21 in a non-conveyance span of the fixing belt 21 where the small sheet P is not conveyed. The small sheet P is one of sheets P having increased widths greater than the heat generator 231 of the center heater 23*b* in the longitudinal direction thereof. The controller 90 controls the lateral end heater 23*a* precisely to cause the lateral end heater 23*a* to generate heat so as to fix the toner image T on the small sheet P when the small sheet P is conveyed through the fixing device 20. Accordingly, the lateral end sensor 27*b* is located at a position where the lateral end sensor 27*b* detects temperature increase or overheating of a non-conveyance span Ha of the fixing belt 21. The non-conveyance span Ha is outboard from a conveyance span Wa where a minimum size sheet P among the sheets P having the increased widths. A detection span S where the lateral end sensor 27*b* detects the temperature of the fixing belt 21 precisely has a substantial width in the longitudinal direction of the lateral end heater 23*a*. Hence, the lateral end sensor 27*b* is positioned relative to the lateral end heater 23*a* such that the detection span S encompasses the non-conveyance span Ha where the fixing belt 21 is susceptible to temperature increase or overheating.

A second purpose is that the lateral end sensor 27*b* detects temperature decrease of the fixing belt 21 in a lateral end span of a conveyance span of the fixing belt 21 where the large sheet P is conveyed. Accordingly, the lateral end sensor 27*b* is located at a position where the lateral end sensor 27*b* detects temperature decrease of a lateral end span Jb of a conveyance span Wb of the fixing belt 21 where the large sheet P is conveyed. Hence, the lateral end sensor 27*b* is positioned relative to the lateral end heater 23*a* such that the detection span S encompasses the lateral end span Jb where the fixing belt 21 is susceptible to temperature decrease.

FIG. 5B is a partial cross-sectional view of the fixing device 20. FIG. 5B illustrates a conveyance span Wc greater than the conveyance span Wb depicted in FIG. 5A in the longitudinal direction of the lateral end heater 23*a*. An extra-large sheet P is conveyed over the conveyance span Wc of the fixing belt 21. FIG. 5C is a partial cross-sectional view of the fixing device 20. If the lateral end heater 23*a* is configured to heat the conveyance span Wc of the fixing belt 21, a lateral end span Jc where the fixing belt 21 suffers from temperature decrease when the extra-large sheet P is conveyed over the fixing belt 21 is spaced apart from a center of the fixing belt 21 in the axial direction thereof farther than the lateral end span Jb depicted in FIG. 5A is. In this case, if the lateral end sensor 27*b* is situated at the position illustrated in FIG. 5A, the detection span S does not encompass the lateral end span Jc where the fixing belt 21 suffers from temperature decrease when the extra-large sheet P is conveyed over the fixing belt 21 as illustrated in FIG. 5B. Accordingly, the lateral end sensor 27*b* does not detect temperature decrease of the fixing belt 21 precisely.

Conversely, to address this circumstance, if the lateral end sensor 27*b* is situated at a position illustrated in FIG. 5C that is outboard from the position of the lateral end sensor 27*b* illustrated in FIG. 5B in the longitudinal direction of the lateral end heater 23*a*, the detection span S does not encompass the non-conveyance span Ha of the small sheet P where the fixing belt 21 is susceptible to temperature increase when the small sheet P having the width greater than the heat generator 231 of the center heater 23*b* in the longitudinal direction thereof is conveyed over the fixing belt 21. Accordingly, the lateral end sensor 27*b* does not detect temperature increase of the fixing belt 21 precisely when the small sheet P is conveyed over the fixing belt 21.

Hence, as the maximum size of the sheets P available in the fixing device 20 increases, the lateral end sensor 27*b* is requested to detect the temperature of the fixing belt 21 in an increased detection span. Accordingly, the single lateral end sensor 27*b* may not precisely detect both temperature increase in the lateral end span Ha of the non-conveyance span where the small sheet P is not conveyed over the fixing belt 21 and temperature decrease in the lateral end span Jc of the conveyance span Wc where the large sheet P is conveyed over the fixing belt 21.

A description is provided of a configuration of a comparative fixing device incorporating a plurality of heaters to vary a heating span depending on the width of a sheet conveyed over a fixing rotator (e.g., a fixing roller).

The comparative fixing device includes a center heater and a lateral end heater. The center heater has a center heat generator disposed at a center span of the center heater in a longitudinal direction thereof. The lateral end heater has a lateral end heat generator disposed at each lateral end span of the lateral end heater in a longitudinal direction thereof. A plurality of temperature detectors (e.g., thermistors) is disposed opposite the center heat generator and the lateral end heat generator, respectively, to detect the temperature of the fixing rotator.

If the comparative fixing device is requested to change a maximum heating span in an axial direction of the fixing rotator where the center heat generator and the lateral end heat generator heat the fixing rotator, for example, from a span corresponding to an A3 size sheet to a span corresponding to an A3 extension size sheet greater than the A3 size sheet, the lateral end heat generator is requested to enlarge. Accordingly, location of the temperature detectors is examined. For example, an extra temperature detector is disposed opposite an extension span disposed outboard from the A3 size sheet in the axial direction of the fixing rotator. The extra temperature detector detects the temperature of the extension span of the fixing rotator to prevent cold offset in the extension span. However, the extra temperature detector may increase manufacturing costs. To address this circumstance, instead of installation of the extra temperature detector, a target temperature to which the lateral end heater heats the fixing rotator is increased to prevent cold offset. For example, the number of the temperature detectors is not changed. However, the higher target temperature of the fixing rotator may degrade energy saving. Additionally, the higher target temperature may overheat a non-conveyance span of the fixing rotator where the sheet is not conveyed. To address this circumstance, a movable shield is installed to shield the fixing rotator from the lateral end heater. However, the movable shield may increase manufacturing costs. To address this circumstance, the comparative fixing device is requested to detect the temperature of the extension span of the fixing rotator without installation of the extra temperature detector and the movable shield so as to attain both energy saving and reduced manufacturing costs.

To address those circumstances, the fixing device 20 has a configuration described below.

As illustrated in FIG. 2, the nip formation pad 24 includes an increased thermal conductivity conductor 51. For example, the nip formation pad 24 includes a base 50 and the increased thermal conductivity conductor 51. The base 50 is disposed opposite the fixing nip N via the increased thermal conductivity conductor 51. The increased thermal conductivity conductor 51 is sandwiched between the base 50 and the fixing belt 21 at the fixing nip N. According to this exemplary embodiment, a nip side face of the increased thermal conductivity conductor 51 mounts the low-friction sheet 29. Alternatively, the low-friction sheet 29 may be omitted.

A thermal conductivity of the increased thermal conductivity conductor 51 is greater than a thermal conductivity of the base 50. For example, the increased thermal conductivity conductor 51 is made of carbon nanotube having a thermal conductivity in a range of from 3,000 W/mK to 5,500 W/mK, graphite sheet having a thermal conductivity in a range of from 700 W/mK to 1,750 W/mK, silver having a thermal conductivity of 420 W/mK, copper having a thermal conductivity of 398 W/mK, aluminum having a thermal conductivity of 236 W/mK, steel electrolytic cold commercial (SECC), or the like. The increased thermal conductivity conductor 51 has a thermal conductivity not smaller than 236 W/mK. For example, the base 50 is made of heat resistant resin such as PES, PPS, LCP, PEN, PAI, and PEEK.

Figure 6:
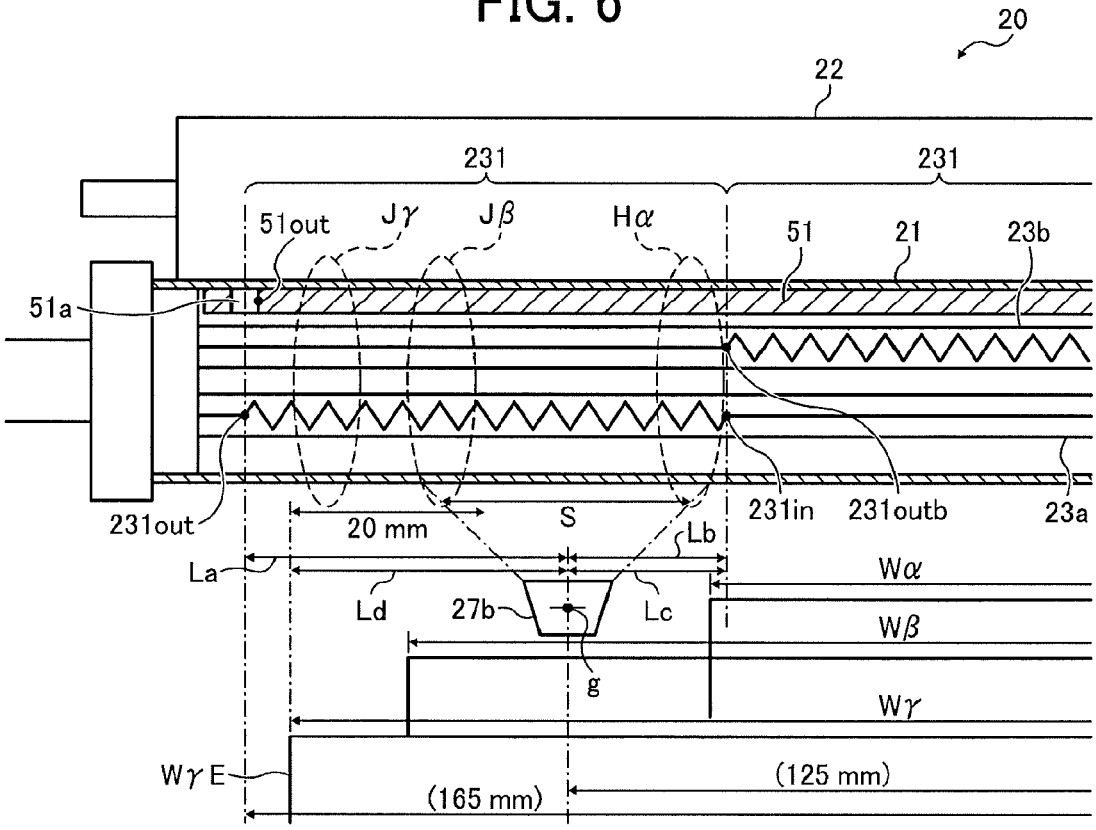
FIG. 6 is a partial cross-sectional view of the fixing device depicted in FIG. 2, illustrating a position of a fixing belt, a pressure roller, the lateral end heater, the center heater, an increased thermal conductivity conductor, and the lateral end sensor and a relation to conveyance spans where sheets of various sizes are conveyed, respectively.

FIG. 6 is a partial cross-sectional view of the fixing device 20 illustrating a position of the fixing belt 21, the pressure roller 22, the lateral end heater 23*a*, the center heater 23*b*, the increased thermal conductivity conductor 51, and the lateral end sensor 27*b* and a relation to conveyance spans Wα, Wβ, and Wγ where sheets P of various sizes arc conveyed, respectively. FIG. 6 illustrates values with parenthesis that indicate a length or a distance from the center of the fixing belt 21 in the axial direction thereof. In a description below, the center and each lateral end of the fixing belt 21 in the axial direction thereof are also mentioned as an inboard section and an outboard section of the fixing belt 21 in the axial direction thereof, respectively.

The conveyance span Wα is a span where the small sheet P, that is, a minimum size sheet, slightly greater than the heat generator 231 of the center heater 23*b* in the longitudinal direction thereof is conveyed over the fixing belt 21. The conveyance span Wβ is a span where the large sheet P having a width greater than the conveyance span Wα in the longitudinal direction of the lateral end heater 23*a* is conveyed over the fixing belt 21. For example, an A3 size sheet is conveyed in the conveyance span Wβ. The conveyance span Wγ is a span where the extra-large sheet P, that is, a maximum size sheet, is conveyed over the fixing belt 21. For example, an A3 extension size sheet is conveyed in the conveyance span Wγ. However, the sizes of sheets described above are one example and therefore sheets of other sizes may be used.

In order to encompass the conveyance span Wγ of the A3 extension size sheet as the maximum size sheet, the heat generator 231 of the lateral end heater 23*a* has an outboard edge 231 out disposed outboard from an outboard edge WγE of the conveyance span Wγ of the A3 extension size sheet in the longitudinal direction of the lateral end heater 23*a*. Conversely, the heat generator 231 of the lateral end heater 23*a* has an inboard edge 231 in substantially disposed opposite an outboard edge 231 outb of the heat generator 231 of the center heater 23*b*.

A center g of the detection span S of the lateral end sensor 27*b* or a center of the lateral end sensor 27*b* in the axial direction of the fixing belt 21 is distanced from the center of the fixing belt 21 by 125 mm in the axial direction of the fixing belt 21. Accordingly, the detection span S of the lateral end sensor 27*b* encompasses a temperature increase span Hα where the fixing belt 21 is susceptible to temperature increase and a temperature decrease span Jβ where the fixing belt 21 is susceptible to temperature decrease. The temperature increase span Hα is in a non-conveyance span disposed outboard from the conveyance span Wα of the small sheet P in the axial direction of the fixing belt 21. The temperature decrease span Jβ is in the conveyance span Wβ of the large sheet P (e.g., the A3 size sheet) in the axial direction of the fixing belt 21. Conversely, the detection span S of the lateral end sensor 27*b* does not encompass a temperature decrease span Jγ disposed in the conveyance span Wγ of the extra-large sheet P (e.g., the A3 extension size sheet) in the axial direction of the fixing belt 21. That is, the temperature decrease span Jγ where the fixing belt 21 is susceptible to temperature decrease when the extra-large sheet P is conveyed is apparently outside the detection span S where the lateral end sensor 27*b* detects the temperature of the fixing belt 21 precisely.

To address this circumstance, according to this exemplary embodiment, the increased thermal conductivity conductor 51 extends continuously throughout the entire width of the fixing belt 21 in the axial direction thereof. The increased thermal conductivity conductor 51 conducts heat from the temperature decrease span Jγ to the detection span S, allowing the lateral end sensor 27*b* to detect temperature decrease of the fixing belt 21 in the temperature decrease span Jγ when the A3 extension size sheet is conveyed. Since the increased thermal conductivity conductor 51 facilitates heat conduction in the fixing belt 21 in the axial direction thereof, heat in the temperature decrease span Jγ when the A3 extension size sheet is conveyed dissipates quickly to a periphery. Accordingly, even if the temperature decrease span Jγ is outside the detection span S, temperature decrease generated in the temperature decrease span Jγ appears in the detection span S quickly, allowing the lateral end sensor 27*b* to detect temperature decrease of the fixing belt 21.

In order to cause temperature decrease generated at the temperature decrease span Jγ situated at a lateral end of the conveyance span Wγ in the axial direction of the fixing belt 21 to influence the temperature in the detection span S of the lateral end sensor 27*b*, the increased thermal conductivity conductor 51 extends continuously from the lateral end of the conveyance span Wγ of the A3 extension size sheet to the detection span S of the lateral end sensor 27*b* in the axial direction of the fixing belt 21. For example, an outboard edge 51 out of the increased thermal conductivity conductor 51 is disposed outboard from the outboard edge WγE of the conveyance span Wγ of the A3 extension size sheet in the axial direction of the fixing belt 21. The increased thermal conductivity conductor 51 extends continuously from the outboard edge 51 out to a center of the increased thermal conductivity conductor 51 in a longitudinal direction thereof parallel to the axial direction of the fixing belt 21 symmetrically via the center of the fixing belt 21 in the axial direction thereof.

The outboard edge 51 out of the increased thermal conductivity conductor 51 does not define an outermost end of the entire increased thermal conductivity conductor 51 in the longitudinal direction thereof but does define an inboard edge of a slot 51*a* disposed at each lateral end of the increased thermal conductivity conductor 51 in the longitudinal direction thereof.

A description is provided of a reason of such definition of the outboard edge 51 out.

Each slot 51*a* of the increased thermal conductivity conductor 51 positions the increased thermal conductivity conductor 51 to the base 50 of the nip formation pad 24. As a projection serving as a positioner projecting from the base 50 is inserted into each slot 51*a* of the increased thermal conductivity conductor 51, the increased thermal conductivity conductor 51 is positioned to the base 50 in the longitudinal direction of the increased thermal conductivity conductor 51.

Figure 7:
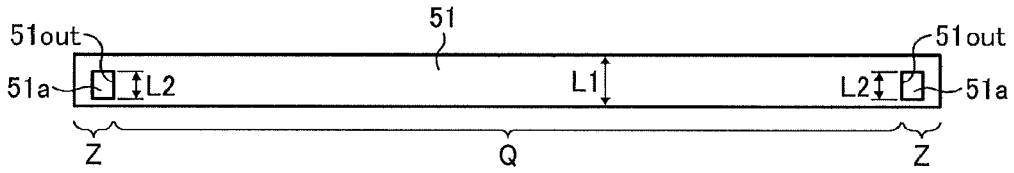
FIG. 7 is a plan view of the increased thermal conductivity conductor depicted in FIG. 6.

The slot 51*a* decreases an area where the increased thermal conductivity conductor 51 contacts the fixing belt 21, thus reducing heat conduction from a portion provided with the slot 51*a* outward in the longitudinal direction of the increased thermal conductivity conductor 51. FIG. 7 is a plan view of the increased thermal conductivity conductor 51. For example, as illustrated in FIG. 7, a length L2 of the slot 51*a* in the sheet conveyance direction A1 is greater than a half of a length L1 of the increased thermal conductivity conductor 51 in the sheet conveyance direction A1, decreasing the amount of heat conducted from the slot 51 a outward in the longitudinal direction of the increased thermal conductivity conductor 51. A center span portion Q spanning from one slot 51*a* to another slot 51*a* through the center of the increased thermal conductivity conductor 51 in the longitudinal direction thereof serves mainly as a thermal conductor. Conversely, an outboard span portion Z disposed outboard from the outboard edge 51 out and each slot 51*a* in the longitudinal direction of the increased thermal conductivity conductor 51, although the outboard span portion Z conducts heat slightly, achieves a decreased thermal conduction compared to the center span portion Q. Hence, the outboard span portion Z serves mainly as a positioner.

Accordingly, an outboard edge of the center span portion Q serving as the thermal conductor of the increased thermal conductivity conductor 51 to conduct heat in the fixing belt 21 in the axial direction thereof, that is, the inboard edge of the slot 51*a* in the longitudinal direction of the increased thermal conductivity conductor 51, defines the outboard edge 51 out of the increased thermal conductivity conductor 51 in the longitudinal direction thereof. Unlike the increased thermal conductivity conductor 51 according to this exemplary embodiment, if the length L2 of the slot 51*a* in the sheet conveyance direction A1 is smaller than the half of the length L1 of the increased thermal conductivity conductor 51 in the sheet conveyance direction A1, the outboard span portion Z disposed outboard from the slot 51*a* in the longitudinal direction of the increased thermal conductivity conductor 51 serves mainly as a thermal conductor. Accordingly, an outboard end of the entire increased thermal conductivity conductor 51 in the longitudinal direction thereof, including the outboard span portion Z disposed outboard from the slot 51*a* in the longitudinal direction of the increased thermal conductivity conductor 51, defines the outboard edge 51 out of the increased thermal conductivity conductor 51 in the longitudinal direction thereof.

Figure 8:
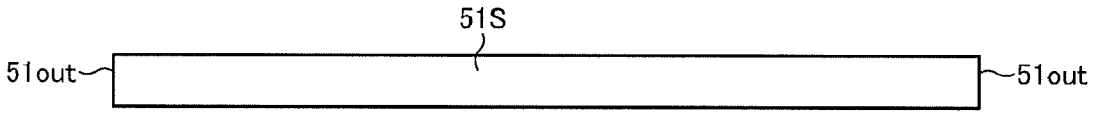
FIG. 8 is a plan view of an increased thermal conductivity conductor as a variation of the increased thermal conductivity conductor depicted in FIG. 7.

FIG. 8 is a plan view of an increased thermal conductivity conductor 51S as a variation of the increased thermal conductivity conductor 51 depicted in FIG. 7. As illustrated in FIG. 8, the increased thermal conductivity conductor 51S does not incorporate the slot 51*a* serving as a positioner disposed at each lateral end of the increased thermal conductivity conductor 51S in a longitudinal direction thereof. In this case, the increased thermal conductivity conductor 51S attains a uniform contact length in the sheet conveyance direction A1 in which the increased thermal conductivity conductor 51S contacts the fixing belt 21 throughout the entire width of the increased thermal conductivity conductor 51S in the longitudinal direction thereof. Thus, the entire increased thermal conductivity conductor 51S serves as a thermal conductor. Accordingly, as illustrated in FIG. 8, an outboard edge of the entire increased thermal conductivity conductor 51S in the longitudinal direction thereof defines the outboard edge 51 out of the increased thermal conductivity conductor 51S in the longitudinal direction thereof.

Referring back to FIG. 6, in order to allow the increased thermal conductivity conductor 51 to dissipate a decreased amount of heat that appears as temperature decrease so that the lateral end sensor 27*b* detects the temperature decrease precisely, the lateral end sensor 27*b* is disposed relative to the fixing belt 21 in view of location of a portion of the fixing belt 21 that suffers from temperature decrease and a heat conduction span of the increased thermal conductivity conductor 51 where the increased thermal conductivity conductor 51 conducts heat. For example, if the heat conduction span of the increased thermal conductivity conductor 51 is 20 mm in the axial direction of the fixing belt 21, the lateral end sensor 27*b* is positioned relative to the fixing belt 21 such that a lateral end span of 20 mm spanning from the lateral edge WγE of the conveyance span Wγ of the A3 extension size sheet where the fixing belt 21 is susceptible to temperature decrease most to a spot inboard from the lateral edge WγE of the conveyance span Wγ overlaps at least a part of the detection span S of the lateral end sensor 27*b* in the axial direction of the fixing belt 21.

The heat conduction span of the increased thermal conductivity conductor 51 varies depending on the thickness and the material of the increased thermal conductivity conductor 51. According to this exemplary embodiment, since the increased thermal conductivity conductor 51 is made of a material having a thickness of 0.4 mm and a thermal conductivity not smaller than 236 W/mK, the heat conduction span is 20 mm. Alternatively, the heat conduction span of the increased thermal conductivity conductor 51 may vary depending on the thickness and the material of the increased thermal conductivity conductor 51. Additionally, the increased thermal conductivity conductor 51 may not extend throughout the entire width of the nip formation pad 24 in a longitudinal direction thereof parallel to the axial direction of the fixing belt 21.

Figure 9:
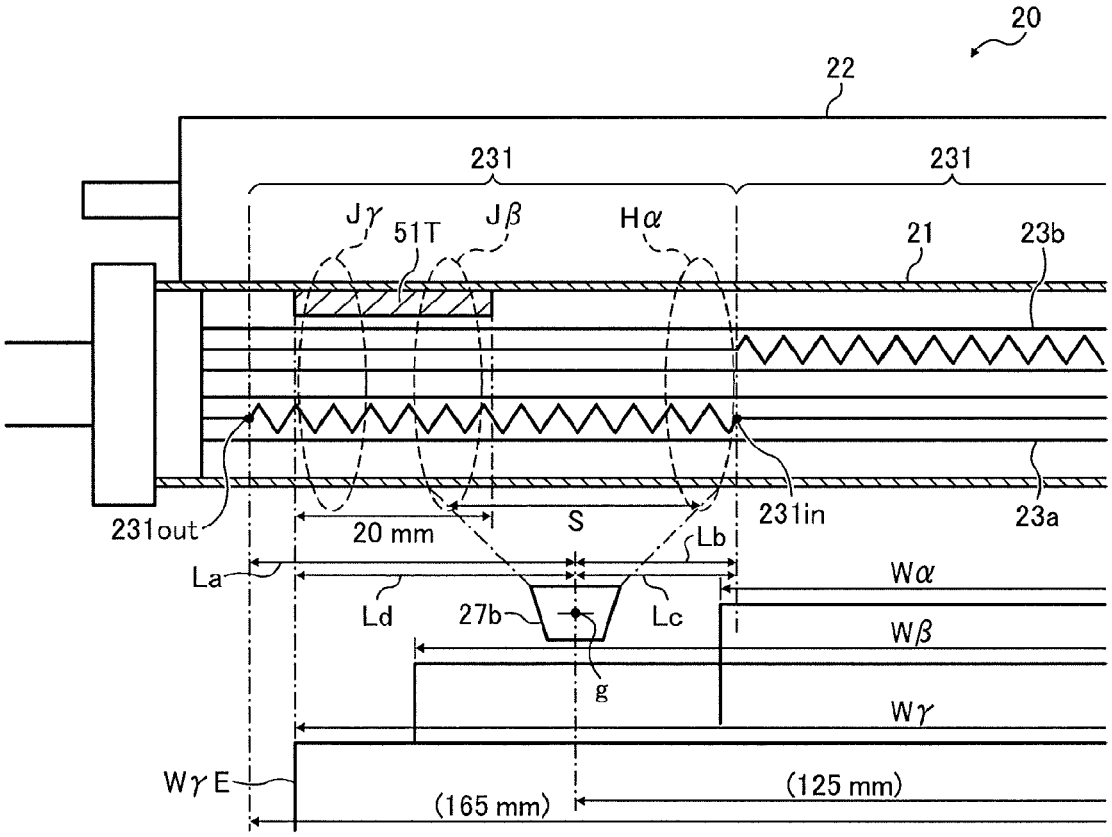
FIG. 9 is a partial cross-sectional view of the fixing device depicted in FIG. 6, illustrating an increased thermal conductivity conductor as another variation of the increased thermal conductivity conductor depicted in FIG. 7.

FIG. 9 is a partial cross-sectional view of the fixing device 20 incorporating an increased thermal conductivity conductor 51T instead of the increased thermal conductivity conductor 51 depicted in FIG. 6. As illustrated in FIG. 9, the increased thermal conductivity conductor 51T spans from the lateral edge WγE of the conveyance span Wγ of the A3 extension size sheet to the spot inboard from the lateral edge WγE of the conveyance span Wγ by at least 20 mm in the axial direction of the fixing belt 21 to define the heat conduction span of at least 20 mm in the axial direction of the fixing belt 21. The increased thermal conductivity conductor 51T overlaps the detection span S of the lateral end sensor 27*b* in the axial direction of the fixing belt 21.

According to the exemplary embodiments described above, an increased thermal conductivity conductor (e.g., the increased thermal conductivity conductors 51, 51S, and 51T) enlarges the detection span S of the lateral end sensor 27*b* substantially without increasing the number of the lateral end sensors 27*b*. For example, even if the lateral end heater 23*a* is elongated and thereby the lateral end sensor 27*b* is requested to detect the temperature of the fixing belt 21 in an increased detection span, the single lateral end sensor 27*b* detects the temperature of the fixing belt 21 precisely. Accordingly, even if the heat generator 231 of the lateral end heater 23*a* that corresponds to the A3 size sheet as the maximum size sheet available in the fixing device 20 is elongated to correspond to the A3 extension size sheet, the lateral end sensor 27*b* is not displaced outward in the axial direction of the fixing belt 21. Thus, the lateral end sensor 27*b* is spaced apart from the lateral edge WγE of the conveyance span Wγ serving as the maximum conveyance span in the axial direction of the fixing belt 21. For example, the lateral end sensor 27*b* is spaced apart from and disposed inboard from the lateral edge WγE of the conveyance span Wγ in the axial direction of the fixing belt 21 by 25 mm or greater.

Additionally, as illustrated in FIG. 6, the lateral end sensor 27*b* spaced apart from the lateral edge WγE of the maximum conveyance span (e.g., the conveyance span Wγ) defines a ratio of a length La to a length Lb as below. The length Lb spans from the center g of the detection span S of the lateral end sensor 27*b* in the axial direction of the fixing belt 21 to the inboard edge 231 in of the heat generator 231 of the lateral end heater 23*a* in the longitudinal direction thereof. The length La spans from the center g of the detection span S of the lateral end sensor 27*b* in the axial direction of the fixing belt 21 to the outboard edge 231 out of the heat generator 231 of the lateral end heater 23*a* in the longitudinal direction thereof. The ratio of the length La to the length Lb is greater than 7/3. The ratio of 7/3 of the fixing device 20 depicted in FIG. 6 is based on the ratio of the length La to the length Lb of 7/3 applied to a fixing device in which the A3 size sheet is the maximum size sheet available. That is, the lateral end sensor 27*b* according to this exemplary embodiment is spaced apart from the lateral edge WγE of the maximum conveyance span (e.g., the conveyance span Wγ) in the axial direction of the fixing belt 21 farther than the lateral end sensor 27*b* installed in the fixing device in which the A3 size sheet is the maximum size sheet available.

However, if the length La is great excessively, the lateral end sensor 27*b* may be spaced apart excessively from the heat conduction span of the increased thermal conductivity conductor 51. Accordingly, the lateral end sensor 27*b* may not detect temperature decrease of the fixing belt 21 precisely when the maximum size sheet (e.g., the A3 extension size sheet) is conveyed. To address this circumstance, the ratio of the length La to the length Lb is smaller than 10/3.

Additionally, as illustrated in FIG. 6, the lateral end sensor 27*b* is spaced apart from the lateral edge WγE of the maximum conveyance span (e.g., the conveyance span Wγ) in the axial direction of the fixing belt 21. A length Ld spans from the center g of the detection span S of the lateral end sensor 27*b* in the axial direction of the fixing belt 21 to the outboard edge WγE of the conveyance span Wγ of the maximum size sheet in the axial direction of the fixing belt 21. A length Lc spans from the center g of the detection span S of the lateral end sensor 27*b* in the axial direction of the fixing belt 21 to the inboard edge 231 in of the heat generator 231 of the lateral end heater 23*a* in the longitudinal direction thereof. The length Ld is greater than the length Lc. For example, the lateral end sensor 27*b* is situated relative to the fixing belt 21 to define a ratio of the length Ld to the length Lc that is greater than 2.06. The ratio of 2.06 of the fixing device 20 depicted in FIG. 6 is based on the ratio of the length Ld to the length Lc of 33.9/16.5 of about 2.054 applied to the fixing device in which the A3 size sheet is the maximum size sheet available. In this case, the length Lc is 16.5 mm. The length Ld is 33.99 mm.

However, if the ratio of the length Ld to the length Lc is great excessively, the lateral end sensor 27*b* may be spaced apart excessively from the heat conduction span of the increased thermal conductivity conductor 51. Accordingly, the lateral end sensor 27*b* may not detect temperature decrease of the fixing belt 21 precisely when the maximum size sheet (e.g., the A3 extension size sheet) is conveyed. To address this circumstance, the ratio of the length Ld to the length Lc is not greater than 2.50.

The above-described configuration of the lateral end sensor 27*b* and the increased thermal conductivity conductor 51 is advantageous substantially in a configuration in which the lateral end heater 23*a* includes the heat generator 231 having an increased width in the axial direction of the fixing belt 21 and the controller 90 controls the lateral end heater 23*a* precisely to generate heat to be conducted to sheets P including the extra-large sheet (e.g., the A3 extension size sheet) for fixing. For example, the lateral end sensor 27*b* and the increased thermal conductivity conductor 51 are advantageous substantially if the heat generator 231 of the lateral end heater 23*a* has a heat generation width greater than 51.5 mm in the longitudinal direction of the lateral end heater 23*a*. The heat generation width of 51.5 mm of the heat generator 231 of the lateral end heater 23*a* installed in the fixing device 20 depicted in FIG. 6 is based on the width of the heat generator 231 of the lateral end heater 23*a* installed in the fixing device in which the A3 size sheet is the maximum size sheet available.

Additionally, the above-described configuration of the lateral end sensor 27*b* and the increased thermal conductivity conductor 51 is also advantageous in a configuration in which the controller 90 controls the lateral end heater 23*a* precisely to generate heat to be conducted to sheets P including sheets having an increased width in the axial direction of the fixing belt 21. For example, the lateral end sensor 27*b* and the increased thermal conductivity conductor 51 are also advantageous substantially in a configuration having an increased difference in width between the minimum size sheet and the maximum size sheet among sheets having a width greater than the heat generator 231 of the center heater 23*b* in the longitudinal direction thereof. For example, a sheet having a width of 217 mm in the axial direction of the fixing belt 21 that is equivalent to the width of the heat generator 231 of the center heater 23*b* is defined as the minimum size sheet. The A3 extension size sheet having a width of 320 mm in the axial direction of the fixing belt 21 is defined as the maximum size sheet. In this case, if the width of 320 mm of the maximum size sheet is greater than the width of 217 mm of the minimum size sheet by 1.48 times, the lateral end sensor 27*b* and the increased thermal conductivity conductor 51 are advantageous substantially. Similarly, if the maximum size sheet available in the fixing device 20 is greater the A3 size sheet having the width of 298 mm, the lateral end sensor 27*b* and the increased thermal conductivity conductor 51 are advantageous substantially.

The fixing device 20 depicted in FIG. 2 includes the lateral end heater 23*a* and the center heater 23*b* that heat the fixing belt 21 directly. Alternatively, the fixing device 20 may include a metal pipe disposed inside the loop formed by the fixing belt 21 so that the lateral end heater 23*a* and the center heater 23*b* heat the fixing belt 21 indirectly via the metal pipe. As illustrated in FIG. 4, the center heater 23*b* includes the cored bar 43 addressing short circuit. Alternatively, the lateral end heater 23*a* may include the cored bar 43. Yet alternatively, the fixing device 20 may include a plurality of heaters, none of which includes the cored bar 43. Yet alternatively, the fixing device 20 may include three or more heaters that heat the fixing belt 21. The fixing device 20 employs a center conveyance system in which the sheets P of various sizes are centered on the fixing belt 21 in the axial direction thereof as the sheets P are conveyed over the fixing belt 21 in the sheet conveyance direction A1. Alternatively, the fixing device 20 may employ a lateral end conveyance system in which the sheet P is conveyed in the sheet conveyance direction A1 along one lateral end of the fixing belt 21 in the axial direction thereof as one side edge of the sheet P is positioned along the one lateral end of the fixing belt 21 in the axial direction thereof.

A description is provided of reference examples of the fixing device 20 having the construction described above.

According to the exemplary embodiments described above, the cored bar 43 addressing short circuit of the center heater 23*b* reduces temperature ripple in the non-heat generator 232, allowing the controller 90 to control the temperature of the fixing belt 21 with improved precision. However, the center heater 23*b* incorporating the cored bar 43 includes the dead coil that barely generates heat. Hence, compared to a heater without the cored bar 43, the cored bar 43 may cause sharp temperature decrease of the fixing belt 21 at a boundary between the heat generator 231 and the non-heat generator 232.

Accordingly, the lateral end heater 23*a* may deviate from the center heater 23*b* in the longitudinal direction thereof due to installation error, dimensional tolerance, or the like of the lateral end heater 23*a* and the center heater 23*b*. A lateral end of the heat generator 231 of the lateral end heater 23*a* may overlap a lateral end of the heat generator 231 of the center heater 23*b* in the longitudinal direction thereof in an overlap span with a decreased overlap amount as indicated by dotted circles in FIG. 3. Further, the lateral end of the heat generator 231 of the lateral end heater 23*a* may be spaced apart from the lateral end of the heat generator 231 of the center heater 23*b* with an interval therebetween in the longitudinal direction thereof. Consequently, the fixing belt 21 may suffer from temperature decrease in the overlap span and the interval between the heat generator 231 of the lateral end heater 23*a* and the heat generator 231 of the center heater 23*b*. To address this circumstance, the reference examples of the fixing device 20 achieve advantages below.

Referring to FIG. 1, a description is provided of a construction of the image forming apparatus 1 in which any one of the reference examples of the fixing device 20 is installed.

As illustrated in FIG. 1, the image forming apparatus 1 is the color laser printer including the four image forming devices 4Y, 4M, 4C, and 4K situated in the center portion thereof. Although the image forming devices 4Y, 4M, 4C, and 4K contain developers (e.g., yellow, magenta, cyan, and black toners) in different colors, that is, yellow, magenta, cyan, and black corresponding to color separation components of a color image, respectively, they have an identical structure.

For example, each of the image forming devices 4Y, 4M, 4C, and 4K includes the drum-shaped photoconductor 5 serving as an image bearer or a latent image bearer that bears an electrostatic latent image and a resultant toner image; the charger 6 that charges the outer circumferential surface of the photoconductor 5; the developing device 7 that supplies toner to the electrostatic latent image formed on the outer circumferential surface of the photoconductor 5, thus visualizing the electrostatic latent image as a toner image; and the cleaner 8 that cleans the outer circumferential surface of the photoconductor 5. It is to be noted that, in FIG. 1, reference numerals are assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is the exposure device 9 that exposes the outer circumferential surface of the respective photoconductors 5 with laser beams. For example, the exposure device 9, constructed of the light source, the polygon mirror, the f-θ lens, the reflection mirrors, and the like, emits a laser beam onto the outer circumferential surface of the respective photoconductors 5 according to image data sent from an external device such as a client computer.

Above the image forming devices 4Y, 4M, 4C, and 4K is the transfer device 3. For example, the transfer device 3 includes the intermediate transfer belt 30 serving as an intermediate transferor, the four primary transfer rollers 31 serving as primary transferors, the secondary transfer roller 36 serving as a secondary transferor, the secondary transfer backup roller 32, the cleaning backup roller 33, the tension roller 34, and the belt cleaner 35.

The intermediate transfer belt 30 is an endless belt stretched taut across the secondary transfer backup roller 32, the cleaning backup roller 33, and the tension roller 34. As the driver drives and rotates the secondary transfer backup roller 32 counterclockwise in FIG. 1, the secondary transfer backup roller 32 rotates the intermediate transfer belt 30 counterclockwise in FIG. 1 in the rotation direction D30 by friction therebetween.

The four primary transfer rollers 31 sandwich the intermediate transfer belt 30 together with the four photoconductors 5, forming the four primary transfer nips between the intermediate transfer belt 30 and the photoconductors 5, respectively. The primary transfer rollers 31 are coupled to the power supply that applies a predetermined DC voltage and/or a predetermined AC voltage thereto.

The secondary transfer roller 36 sandwiches the intermediate transfer belt 30 together with the secondary transfer backup roller 32, forming the secondary transfer nip between the secondary transfer roller 36 and the intermediate transfer belt 30. Similar to the primary transfer rollers 31, the secondary transfer roller 36 is coupled to the power supply that applies a predetermined DC voltage and/or a predetermined AC voltage thereto.

The bottle holder 2 situated in the upper portion of the image forming apparatus 1 accommodates the four toner bottles 2Y, 2M, 2C, and 2K detachably attached thereto to contain and supply fresh yellow, magenta, cyan, and black toners to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through the toner supply tubes interposed between the toner bottles 2Y, 2M, 2C, and 2K and the developing devices 7, respectively.

In the lower portion of the image forming apparatus 1 are the paper tray 10 that loads a plurality of sheets P serving as recording media and the feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, OHP transparencies, and the like. Optionally, the bypass tray that loads thick paper, postcards, envelopes, thin paper, coated paper, art paper, tracing paper, OHP transparencies, and the like may be attached to the image forming apparatus 1.

The conveyance path R extends from the feed roller 11 to the output roller pair 13 to convey the sheet P picked up from the paper tray 10 onto the outside of the image forming apparatus 1 through the secondary transfer nip. The conveyance path R is provided with the registration roller pair 12 located below the secondary transfer nip formed between the secondary transfer roller 36 and the intermediate transfer belt 30, that is, upstream from the secondary transfer nip in the sheet conveyance direction A1. The registration roller pair 12 serving as a timing roller pair conveys the sheet P conveyed from the feed roller 11 toward the secondary transfer nip at a proper time.

The conveyance path R is further provided with the fixing device 20 located above the secondary transfer nip, that is, downstream from the secondary transfer nip in the sheet conveyance direction A1. The fixing device 20 fixes an unfixed toner image transferred from the intermediate transfer belt 30 onto the sheet P conveyed from the secondary transfer nip on the sheet P. The conveyance path R is further provided with the output roller pair 13 located above the fixing device 20, that is, downstream from the fixing device 20 in the sheet conveyance direction A1. The output roller pair 13 ejects the sheet P bearing the fixed toner image onto the outside of the image forming apparatus 1, that is, the output tray 14 disposed atop the image forming apparatus 1. The output tray 14 stocks the sheet P ejected by the output roller pair 13.

Referring to FIG. 1, a description is provided of an image forming operation performed by the image forming apparatus 1 having the construction described above and incorporating any one of the reference examples described below to form a full color toner image on a sheet P.

As a print job starts, the driver drives and rotates the photoconductors 5 of the image forming devices 4Y, 4M, 4C, and 4K, respectively, clockwise in FIG. 1 in the rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constituting color image data sent from the external device, respectively, thus forming electrostatic latent images thereon. The image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the photoconductors 5, visualizing the electrostatic latent images as yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at the respective primary transfer nips formed between the photoconductors 5 and the primary transfer rollers 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on the same position on the intermediate transfer belt 30. Thus, a full color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively.

On the other hand, the feed roller 11 disposed in the lower portion of the image forming apparatus 1 is driven and rotated to feed a sheet P from the paper tray 10 toward the registration roller pair 12 in the conveyance path R. The registration roller pair 12 halts the sheet P temporarily.

Thereafter, the registration roller pair 12 resumes rotation at a predetermined time to convey the sheet P to the secondary transfer nip at a time when the full color toner image formed on intermediate transfer belt 30 reaches the secondary transfer nip. The secondary transfer roller 36 is applied with a transfer voltage having a polarity opposite a polarity of the charged yellow, magenta, cyan, and black toners constituting the full color toner image formed on the intermediate transfer belt 30, thus creating a transfer electric field at the secondary transfer nip. Thus, the yellow, magenta, cyan, and black toner images constituting the full color toner image are secondarily transferred from the intermediate transfer belt 30 onto the sheet P collectively by the transfer electric field created at the secondary transfer nip. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom.

Thereafter, the sheet P bearing the full color toner image is conveyed to the fixing device 20 that fixes the full color toner image on the sheet P. Then, the sheet P bearing the fixed full color toner image is ejected by the output roller pair 13 onto the outside of the image forming apparatus 1, that is, the output tray 14 that stocks the sheet P.

The above describes the image foaming operation of the image forming apparatus 1 to form the full color toner image on the sheet P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 10:
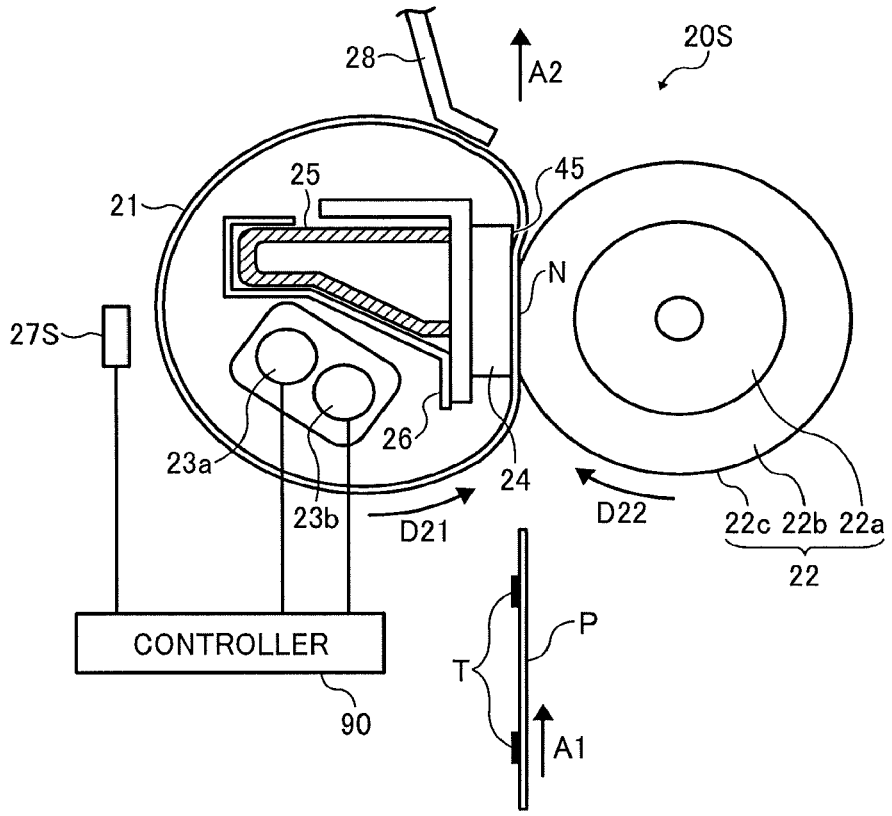
FIG. 10 is a schematic vertical cross-sectional view of a fixing device as a reference example.

Referring to FIG. 10, a description is provided of a construction of a fixing device 20S as the reference example that is installable in the image forming apparatus 1 having the construction described above.

FIG. 10 is a schematic vertical cross-sectional view of the fixing device 20S. As illustrated in FIG. 10, the fixing device 20S (e.g., a fuser or a fusing unit) includes the fixing belt 21, the pressure roller 22, two heaters, that is, the lateral end heater 23*a* and the center heater 23*b*, the nip formation pad 24, the stay 25, the reflector 26, a temperature sensor 27S, and the separator 28. The fixing belt 21 formed into a loop serves as a fixing rotator or an endless belt rotatable in the rotation direction D21. The pressure roller 22 serves as an opposed rotator that is rotatable in the rotation direction D22 and disposed opposite the fixing belt 21. The lateral end heater 23*a* and the center heater 23*b* serve as a heater or a heat source that heats the fixing belt 21. The nip formation pad 24 presses against the pressure roller 22 via the fixing belt 21 to form the fixing nip N between the fixing belt 21 and the pressure roller 22. The stay 25 serves as a support that supports the nip formation pad 24. The reflector 26 reflects light or heat radiated from the lateral end heater 23*a* and the center heater 23*b* to the fixing belt 21. The temperature sensor 27S serves as a temperature detector that detects the temperature of the outer circumferential surface of the fixing belt 21. The separator 28 separates the sheet P having passed through the fixing nip N from the fixing belt 21.

A detailed description is now given of a construction of the fixing belt 21.

The fixing belt 21 is a thin, flexible endless belt or film. For example, the fixing belt 21 is constructed of the base layer constituting the inner circumferential surface of the fixing belt 21 and the release layer constituting the outer circumferential surface of the fixing belt 21. The base layer is made of metal such as nickel and SUS stainless steel or resin such as PI. The release layer is made of PFA, PTFE, or the like. Optionally, the elastic layer made of rubber such as silicone rubber, silicone rubber foam, and fluoro rubber may be interposed between the base layer and the release layer.

A detailed description is now given of a construction of the pressure roller 22.

The pressure roller 22 is constructed of the cored bar 22*a;* the elastic layer 22*b* coating the cored bar 22*a* and made of silicone rubber foam, silicone rubber, fluoro rubber, or the like; and the release layer 22*c* coating the elastic layer 22*b* and made of PFA, PTFE, or the like. The pressurization assembly including the spring presses the pressure roller 22 against the nip formation pad 24 via the fixing belt 21. The pressure roller 22 pressingly contacting the fixing belt 21 deforms the elastic layer 22*b* of the pressure roller 22 at the fixing nip N formed between the pressure roller 22 and the fixing belt 21, thus defining the fixing nip N having a predetermined length in the sheet conveyance direction A1. The driver (e.g., the motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 by friction between the pressure roller 22 and the fixing belt 21.

According to this reference example, the pressure roller 22 is a solid roller. Alternatively, the pressure roller 22 may be a hollow roller. In this case, a heater may be disposed inside the hollow roller. If the pressure roller 22 does not incorporate the elastic layer 22*b*, the pressure roller 22 has a decreased thermal capacity that improves fixing property of being heated quickly to a predetermined fixing temperature at which a toner image T is fixed on a sheet P properly. However, as the pressure roller 22 and the fixing belt 21 sandwich and press the unfixed toner image T on the sheet P passing through the fixing nip N, slight surface asperities of the fixing belt 21 may be transferred onto the toner image T on the sheet P, resulting in variation in gloss of the solid toner image T. To address this circumstance, it is preferable that the pressure roller 22 incorporates the elastic layer 22*b* having a thickness not smaller than 100 micrometers. The elastic layer 22*b* having the thickness not smaller than 100 micrometers elastically deforms to absorb slight surface asperities of the fixing belt 21, preventing variation in gloss of the toner image T on the sheet P. The elastic layer 22*b* may be made of solid rubber. Alternatively, if no heater is situated inside the pressure roller 22, the elastic layer 22*b* may be made of sponge rubber. The sponge rubber is more preferable than the solid rubber because the sponge rubber has an increased insulation that draws less heat from the fixing belt 21. According to this reference example, the pressure roller 22 is pressed against the fixing belt 21. Alternatively, the pressure roller 22 may merely contact the fixing belt 21 with no pressure therebetween.

A detailed description is now given of a configuration of the lateral end heater 23*a* and the center heater 23*b*.

The two heaters, that is, the lateral end heater 23*a* and the center heater 23*b*, are situated inside the loop formed by the fixing belt 21. Both lateral ends of each of the lateral end heater 23*a* and the center heater 23*b* in the longitudinal direction thereof parallel to the axial direction of the fixing belt 21 are mounted on or secured to the side plates of the fixing device 20, respectively. According to this reference example, the fixing device 20 employs the direct heating method in which the lateral end heater 23*a* and the center heater 23*b* heat the fixing belt 21 directly. The direct heating method heats the fixing belt 21 effectively, saving energy and shortening the warm-up time or the like to warm up the fixing belt 21 to a target temperature. The controller 90 operatively connected to the temperature sensor 27S, the lateral end heater 23*a*, and the center heater 23*b* controls output of each of the lateral end heater 23*a* and the center heater 23*b* based on the temperature of the outer circumferential surface of the fixing belt 21 detected by the temperature sensor 27S. Thus, the temperature of the fixing belt 21 is adjusted to a desired fixing temperature.

A detailed description is now given of a construction of the nip formation pad 24.

The nip formation pad 24 is disposed inside the loop formed by the fixing belt 21 and disposed opposite the pressure roller 22 via the fixing belt 21. The nip formation pad 24 is an elongate pad extending continuously in the axial direction of the fixing belt 21. As the pressure roller 22 is pressed against the nip formation pad 24 via the fixing belt 21, the nip formation pad 24 produces the fixing nip N extending continuously in the axial direction of the fixing belt 21. The nip formation pad 24 is secured to and supported by the stay 25. Accordingly, even if the nip formation pad 24 receives pressure from the pressure roller 22, the nip formation pad 24 is not bent by the pressure and therefore produces a uniform nip length in the sheet conveyance direction A1 throughout the entire width of the pressure roller 22 in the axial direction thereof.

The nip formation pad 24 is coated with a low-friction sheet mounted on the opposed face of the nip formation pad 24 that is disposed opposite the fixing belt 21. Thus, the low-friction sheet is sandwiched between the nip formation pad 24 and the fixing belt 21. As the fixing belt 21 rotates in the rotation direction D21, the fixing belt 21 slides over the low-friction sheet that reduces a driving torque developed between the fixing belt 21 and the nip formation pad 24, reducing load exerted to the fixing belt 21 by friction between the fixing belt 21 and the nip formation pad 24. The bulge 45 projects from the downstream end of the nip formation pad 24 that is in proximity to the exit of the fixing nip N toward the pressure roller 22. The bulge 45 does not press against the pressure roller 22 via the fixing belt 21 and therefore is not produced by contact with the pressure roller 22. The bulge 45 lifts the sheet P conveyed through the exit of the fixing nip N from the fixing belt 21, facilitating separation of the sheet P from the fixing belt 21.

The nip formation pad 24 is made of a heat resistant material resistant against temperatures not lower than 200 degrees centigrade. For example, the nip formation pad 24 is made of general heat resistant resin such as PES, PPS, LCP, PEN, PAL and PEEK. Thus, the nip formation pad 24 made of the heat resistant resin is immune from thermal deformation at temperatures in a fixing temperature range desirable to fix the toner image T on the sheet P, retaining the shape of the fixing nip N and quality of the toner image T formed on the sheet P.

A detailed description is now given of a configuration of the stay 25.

The stay 25 is disposed inside the loop formed by the fixing belt 21. Both lateral ends of the stay 25 in the longitudinal direction thereof parallel to the axial direction of the fixing belt 21 are mounted on or secured to the side plates of the fixing device 20, respectively. The stay 25 is made of metal having an increased mechanical strength, such as stainless steel and iron, to prevent bending of the nip formation pad 24. Alternatively, the stay 25 may be made of resin that attains a desired mechanical strength of the stay 25.

A detailed description is now given of a configuration of the reflector 26.

The reflector 26 is interposed between the stay 25 and the two heaters (e.g., the lateral end heater 23*a* and the center heater 23*b*). The reflector 26 is secured to or mounted on the stay 25, thus being supported by the stay 25. The reflector 26 interposed between the stay 25 and the two heaters (e.g., the lateral end heater 23*a* and the center heater 23*b*) reflects light or heat radiated from the lateral end heater 23*a* and the center heater 23*b* to the stay 25 toward the fixing belt 21, heating the fixing belt 21 effectively. The reflector 26 suppresses conduction of heat from the lateral end heater 23*a* and the center heater 23*b* to the stay 25 and the like, saving energy. Since the reflector 26 is heated by the lateral end heater 23*a* and the center heater 23*b* directly, the reflector 26 is made of metal having an increased melting point or the like. Alternatively, instead of installation of the reflector 26 depicted in FIG. 10, the opposed face of the stay 25 that is disposed opposite the lateral end heater 23*a* and the center heater 23*b* may be treated with polishing or mirror finishing such as coating to produce the reflection face that reflects light or heat radiated from the lateral end heater 23*a* and the center heater 23*b* toward the fixing belt 21. For example, the reflector 26 or the reflection face of the stay 25 has a reflection rate of 90 percent or more.

According to this reference example, in order to decrease the thermal capacity of the fixing belt 21, the fixing belt 21 is thin and has a decreased loop diameter. For example, the fixing belt 21 is constructed of the base layer having a thickness in a range of from 20 micrometers to 50 micrometers; the elastic layer having a thickness in a range of from 100 micrometers to 300 micrometers; and the release layer having a thickness in a range of from 10 micrometers to 50 micrometers. Thus, the fixing belt 21 has a total thickness not greater than 1 mm. A loop diameter of the fixing belt 21 is in a range of from 20 mm to 40 mm. In order to decrease the thermal capacity of the fixing belt 21 further, the fixing belt 21 may have a total thickness not greater than 0.20 mm and preferably not greater than 0.16 mm. Additionally, the loop diameter of the fixing belt 21 may not be greater than 30 mm.

According to this reference example, the pressure roller 22 has a diameter in a range of from 20 mm to 40 mm. Hence, the loop diameter of the fixing belt 21 is equivalent to the diameter of the pressure roller 22. Alternatively, the loop diameter of the fixing belt 21 may be smaller than the diameter of the pressure roller 22. In this case, a curvature of the fixing belt 21 at the fixing nip N is greater than that of the pressure roller 22, facilitating separation of the sheet P ejected from the fixing nip N from the fixing belt 21.

A description is provided of a fixing operation performed by the fixing device 20S having the construction described above.

As the image forming apparatus 1 depicted in FIG. 1 is powered on, only the center heater 23*b* or both the lateral end heater 23*a* and the center heater 23*b* are supplied with power and the driver starts driving and rotating the pressure roller 22 in the rotation direction D22, which in turn rotates the fixing belt 21 in the rotation direction D21. When the fixing belt 21 attains the target temperature, the feed roller 11 depicted in FIG. 1 picks up and feeds a sheet P from the paper tray 10 to the registration roller pair 12 that conveys the sheet P to the secondary transfer nip where an unfixed toner image T is secondarily transferred from the intermediate transfer belt 30 onto the sheet P. As illustrated in FIG. 10, the sheet P bearing the unfixed toner image T is conveyed in the sheet conveyance direction A1 and enters the fixing nip N formed between the fixing belt 21 and the pressure roller 22 pressed against the fixing belt 21. The toner image T is fixed on the sheet P under heat from the fixing belt 21 heated by the lateral end heater 23*a* and the center heater 23*b* and pressure exerted from the pressure roller 22. The sheet P is ejected from the fixing nip N, separated from the fixing belt 21 by the separator 28, and conveyed in the sheet conveyance direction A2.

A description is provided of a construction of the lateral end heater 23*a* and the center heater 23*b* in detail.

Like the lateral end heater 23*a* and the center heater 23*b* illustrated in FIG. 3, each of the lateral end heater 23*a* and the center heater 23*b* depicted in FIG. 10 includes the heat generator 231. The heat generator 231 of the lateral end heater 23*a* is disposed outboard from the heat generator 231 of the center heater 23*b* in the longitudinal direction of the lateral end heater 23*a* and the center heater 23*b* parallel to the width direction of the sheet P. As illustrated in FIG. 10, the lateral end heater 23*a* serving as a secondary heater is disposed upstream from the center heater 23*b* serving as a primary heater in the rotation direction D21 of the fixing belt 21. As illustrated in FIG. 3, the lateral end heater 23*a* mainly heats each lateral end span of the fixing belt 21 in the axial direction thereof. The lateral end heater 23*a* includes the heat generator 231 disposed at each lateral end span of the lateral end heater 23*a* in the longitudinal direction thereof that is disposed opposite each lateral end span of the fixing belt 21 in the axial direction thereof. Conversely, as illustrated in FIG. 10, the center heater 23*b* is disposed downstream from the lateral end heater 23*a* in the rotation direction D21 of the fixing belt 21. As illustrated in FIG. 3, the center heater 23*b* mainly heats the center span of the fixing belt 21 in the axial direction thereof. The center heater 23*b* includes the heat generator 231 disposed at the center span of the center heater 23*b* in the longitudinal direction thereof that is disposed opposite the center span of the fixing belt 21 in the axial direction thereof.

A portion of each of the lateral end heater 23*a* and the center heater 23*b* that is other than the heat generator 231 is the non-heat generator 232 that barely generates heat. The heat generator 231 of the lateral end heater 23*a* is disposed opposite the non-heat generator 232 of the center heater 23*b*. The non-heat generator 232 of the lateral end heater 23*a* is disposed opposite the heat generator 231 of the center heater 23*b*.

With the fixing device 20S according to this reference example, when a small sheet P having a width not greater than the width of the heat generator 231 of the center heater 23*b* in the longitudinal direction thereof is conveyed through the fixing device 20S, the controller 90 depicted in FIG. 10 energizes the center heater 23*b* and does not energize the lateral end heater 23*a*. Accordingly, the center heater 23*b* heats the center span of the fixing belt 21 in the axial direction thereof, allowing the fixing belt 21 to fix the toner image T on the small sheet P conveyed over the center span of the fixing belt 21. The controller 90 does not energize the lateral end heater 23*a* not used to fix the toner image T on the small sheet P, reducing redundant consumption of energy. Conversely, when a large sheet P having a width greater than the width of the heat generator 231 of the center heater 23*b* in the longitudinal direction thereof is conveyed through the fixing device 20S, the controller 90 energizes both the lateral end heater 23*a* and the center heater 23*b*. Accordingly, the lateral end heater 23*a* and the center heater 23*b* heat an increased span spanning from the center span to each lateral end span of the fixing belt 21 in the axial direction thereof, allowing the fixing belt 21 to fix the toner image T on the large sheet P conveyed over the center span and each lateral end span of the fixing belt 21.

Like the temperature sensor 27 illustrated in FIG. 3, according to this reference example, the temperature sensor 27S includes the center sensor 27*a* serving as a first temperature detector and the lateral end sensor 27*b* serving as a second temperature detector. The center sensor 27*a* is disposed opposite the center span of the fixing belt 21 in the axial direction thereof. The lateral end sensor 27*b* is disposed opposite one lateral end span of the fixing belt 21 in the axial direction thereof. The center sensor 27*a* detects the temperature of the center span of the fixing belt 21 in the axial direction thereof. The lateral end sensor 27*b* detects the temperature of the lateral end span of the fixing belt 21 in the axial direction thereof separately from the center sensor 27*a*. The controller 90 controls the center heater 23*b* and the lateral end heater 23*a* based on the temperatures of the fixing belt 21 detected by the center sensor 27*a* and the lateral end sensor 27*b*, respectively, thus retaining the temperature of the fixing belt 21 in a predetermined temperature range.

FIG. 4 illustrates a detailed construction of the lateral end heater 23*a* and the center heater 23*b* according to this reference example. As illustrated in FIG. 4, each of the lateral end heater 23*a* and the center heater 23*b* is the filament lamp including the tubular glass tube 40 made of quartz glass or the like and the filament 41 made of tungsten or the like. The filament 41 is disposed inside the glass tube 40. According to this reference example, the lateral end heater 23*a* and the center heater 23*b* employ filament lamps having different properties, respectively.

For example, the lateral end heater 23*a* includes the heat generation portion 411 (e.g., the luminous portion) where the filament 41 is coiled helically and densely. The heat generation portion 411 spans the entire width of the heat generator 231 in the longitudinal direction of the lateral end heater 23*a*. Conversely, the filament 41 is substantially straight in the non-heat generator 232 of the lateral end heater 23*a*. However, the non-heat generator 232 partially includes the plurality of dense coil portions where the filament 41 is coiled densely. The dense coil portion of the non-heat generator 232 is also called the dead coil and supported by the ring supporter 42 so that the filament 41 retains a desired shape. The supporter 42 is made of tungsten or the like and also situated in the heat generator 231.

Like the lateral end heater 23*a*, the center heater 23*b* includes the heat generation portion 411 (e.g., the luminous portion) where the filament 41 is coiled helically and densely. The heat generation portion 411 spans the entire width of the heat generator 231 in the longitudinal direction of the center heater 23*b*. The heat generation portion 411 is partially supported by the supporters 42. Conversely, the non-heat generator 232 of the center heater 23*b* is different in construction from the non-heat generator 232 of the lateral end heater 23*a*. The non-heat generator 232 of the center heater 23*b* includes the cored bar 43 addressing short circuit that is made of metal such as molybdenum. The filament 41 is coiled around the cored bar 43. The non-heat generator 232 partially includes the plurality of dense coil portions where the filament 41 is coiled densely. The dense coil portions are supported by the supporters 42, respectively.

As described above, the center heater 23*b* is substantially different from the lateral end heater 23*a* in that the non-heat generator 232 of the center heater 23*b* includes the cored bar 43. The cored bar 43 disposed in the non-heat generator 232 suppresses heat generation from the dense coil portions of the filament 41 in the non-heat generator 232. For example, the cored bar 43 decreases the electric resistance of the dense coil portions of the filament 41 in the non-heat generator 232 of the center heater 23*b*, suppressing heat generation compared to heat generation from the dense coil portions (e.g., the dead coils) of the lateral end heater 23*a*.

As described above, according to this reference example, the cored bar 43 of the center heater 23*b* suppresses local heat generation from each lateral end span of the center heater 23*b* in the longitudinal direction thereof. Accordingly, variation in the temperature of the fixing belt 21 is reduced, improving control of the temperature of the fixing belt 21. Additionally, the center heater 23*b* suppresses redundant heat generation in the non-heat generator 232, decreasing power consumption of the center heater 23*b*. Even if the center heater 23*b* shares a common power supply with a lamp, a lighting, or the like, the center heater 23*b* is immune from flicker. In addition to increased power consumption, a shortened control cycle (e.g., a shortened energization cycle) of the center heater 23*b* causes the center heater 23*b* to be susceptible to flicker. According to this reference example, decreased power consumption of the center heater 23*b* shortens the control cycle of the center heater 23*b*, improving control of the temperature of the fixing belt 21.

When the controller 90 causes both the center heater 23*b* and the lateral end heater 23*a* to generate heat, a gap between the heat generator 231 of the center heater 23*b* and the heat generator 231 of the lateral end heater 23*a* may suffer from temperature decrease. To address this circumstance, the lateral end of the heat generator 231 of the lateral end heater 23*a* may overlap the lateral end of the heat generator 231 of the center heater 23*b* in the longitudinal direction thereof in the overlap span slightly as indicated by the dotted circles in FIG. 3.

However, the lateral end heater 23*a* may deviate from the center heater 23*b* in the longitudinal direction thereof due to installation error, dimensional tolerance, or the like of the lateral end heater 23*a* and the center heater 23*b*. The lateral end of the heat generator 231 of the lateral end heater 23*a* may overlap the lateral end of the heat generator 231 of the center heater 23*b* in the longitudinal direction thereof in the overlap span with a decreased overlap amount. Further, the lateral end of the heat generator 231 of the lateral end heater 23*a* may be spaced apart from the lateral end of the heat generator 231 of the center heater 23*b* with an interval therebetween in the longitudinal direction thereof. Consequently, the fixing belt 21 may suffer from temperature decrease in the overlap span and the interval between the heat generator 231 of the lateral end heater 23*a* and the heat generator 231 of the center heater 23*b*. As illustrated in FIG. 4, according to this reference example, the center heater 23*b* includes the cored bar 43 addressing short circuit. Hence, compared to a heater without the cored bar 43, the cored bar 43 may cause sharp temperature decrease of the fixing belt 21 at the boundary between the heat generator 231 and the non-heat generator 232. Accordingly, if the lateral end heater 23*a* deviates from the center heater 23*b* as described above, the boundary between the lateral end of the heat generator 231 of the lateral end heater 23*a* and the lateral end of the heat generator 231 of the center heater 23*b* in the longitudinal direction thereof may suffer from conspicuous temperature decrease. To address such temperature decrease, the fixing device 20S according to this reference example has a configuration described below.

Figure 11:
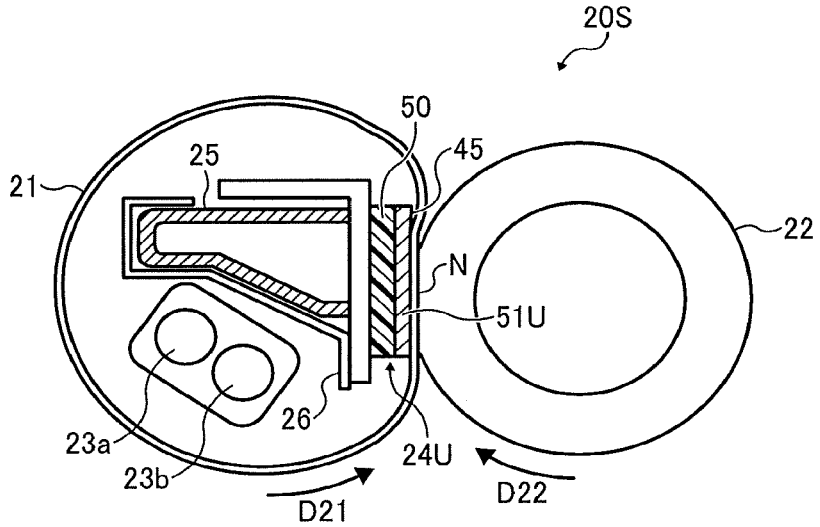
FIG. 11 is a partial cross-sectional view of the fixing device depicted in FIG. 10, illustrating a nip formation pad incorporated therein.

FIG. 11 is a partial cross-sectional view of the fixing device 20S incorporating a nip formation pad 24U as a variation of the nip formation pad 24 depicted in FIG. 10. As illustrated in FIG. 11, the nip formation pad 24U according to this reference example includes the base 50 serving as a decreased thermal conductivity conductor and an increased thermal conductivity conductor 51U (e.g., a thermal equalizer) sandwiched between the base 50 and the fixing belt 21 at the fixing nip N. The increased thermal conductivity conductor 51U contacts the inner circumferential surface of the fixing belt 21 when the pressure roller 22 is pressed against the nip formation pad 24U via the fixing belt 21 to form the fixing nip N.

A thermal conductivity of the increased thermal conductivity conductor 51U is greater than a thermal conductivity of the base 50. For example, the increased thermal conductivity conductor 51U is made of carbon nanotube, graphite sheet, silver, copper, aluminum, SECC, or the like. Conversely, the base 50 is made of heat resistant resin such as PES, PPS, LCP, PEN, PAI, and PEEK.

A detailed description is now given of a construction of the increased thermal conductivity conductor 51U.

Figure 12:
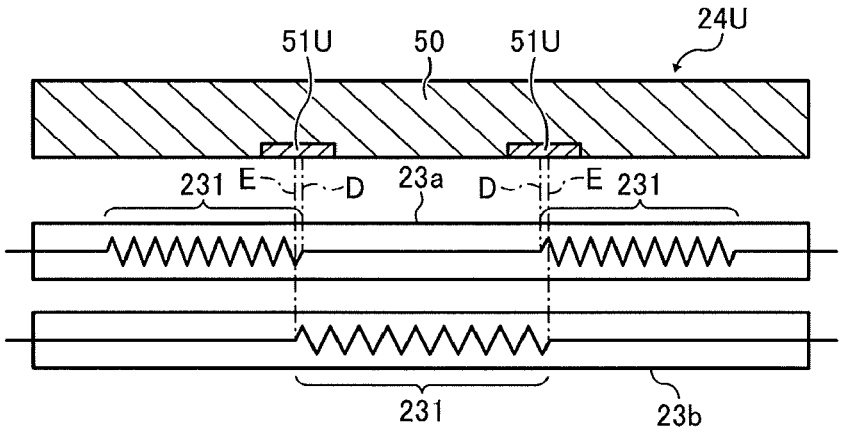
FIG. 12 is a cross-sectional view of the nip formation pad, the lateral end heater, and the center heater incorporated in the fixing device depicted in FIG. 11, illustrating an increased thermal conductivity conductor incorporated in the nip formation pad.

FIG. 12 is a cross-sectional view of the nip formation pad 24U, the lateral end heater 23*a*, and the center heater 23*b*. As illustrated in FIG. 12, the increased thermal conductivity conductor 51U is disposed opposite an inboard end D of the heat generator 231 of the lateral end heater 23*a* and an outboard end E of the heat generator 231 of the center heater 23*b*. The outboard end E is disposed outboard from the inboard end D in the axial direction of the fixing belt 21. The inboard end D is disposed opposite the heat generator 231 of the center heater 23*b*. The outboard end E is disposed opposite the heat generator 231 of the lateral end heater 23*a*. For example, the increased thermal conductivity conductor 51U encompasses the inboard end D of the heat generator 231 of the lateral end heater 23*a* and the outboard end E of the heat generator 231 of the center heater 23*b* in the longitudinal direction of the lateral end heater 23*a* and the center heater 23*b*. The inboard end D defines an inboard edge of the heat generator 231 of the lateral end heater 23*a* in the longitudinal direction thereof. The outboard end E defines an outboard edge of the heat generator 231 of the center heater 23*b* in the longitudinal direction thereof.

Accordingly, even if the lateral end heater 23*a* deviates from the center heater 23*b* in the longitudinal direction thereof, the increased thermal conductivity conductor 51U facilitates heat conduction from an increased temperature portion to a decreased temperature portion of the fixing belt 21 in the axial direction thereof, thus suppressing temperature decrease at an axial span between the lateral ends D and E on the fixing belt 21 in the axial direction thereof. Consequently, it is not requested to increase the target temperature of the fixing belt 21 to which the lateral end heater 23*a* and the center heater 23*b* heat the fixing belt 21 and to install another temperature sensor, saving energy and reducing manufacturing costs.

Figure 13:
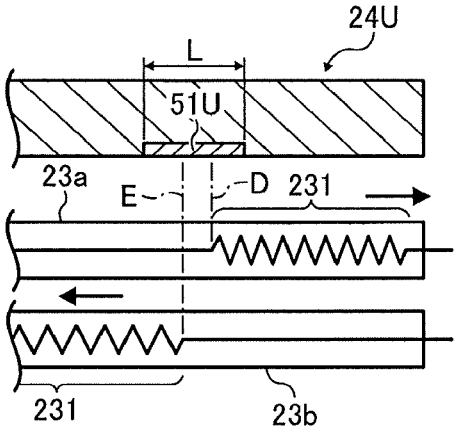
FIG. 13 is a partial cross-sectional view of the nip formation pad, the lateral end heater, and the center heater depicted in FIG. 12.

FIG. 13 is a partial cross-sectional view of the nip formation pad 24U, the lateral end heater 23*a*, and the center heater 23*b*. As illustrated in FIG. 13, even if the lateral end heater 23*a* or the center heater 23*b* is displaced in the longitudinal direction thereof, an axial span L of the increased thermal conductivity conductor 51U in a longitudinal direction of the nip formation pad 24U parallel to the axial direction of the fixing belt 21 encompasses the lateral ends D and E in the axial direction of the fixing belt 21. For example, according to this reference example, since the outboard end E of the heat generator 231 of the center heater 23*b* suffers from sharp temperature decrease, the increased thermal conductivity conductor 51U spans the axial span L so that the increased thermal conductivity conductor 51U is disposed opposite the outboard end E even when the lateral end heater 23*a* and the center heater 23*b* are displaced in the axial direction of the fixing belt 21 as indicated arrows in FIG. 13.

In addition to the increased thermal conductivity conductor 51U incorporated in the nip formation pad 24U, an opposed portion of the fixing belt 21 that is disposed opposite the lateral ends D and E may be made of a material having a thermal conductivity not smaller than 50 W/mK. Thus, the opposed portion of the fixing belt 21 facilitates heat conduction in the axial direction of the fixing belt 21. Accordingly, even if the lateral end heater 23*a* deviates relative to the center heater 23*b*, the opposed portion of the fixing belt 21 reduces temperature decrease of the fixing belt 21 effectively.

A description is provided of variations of the increased thermal conductivity conductor 51U.

Figure 14:
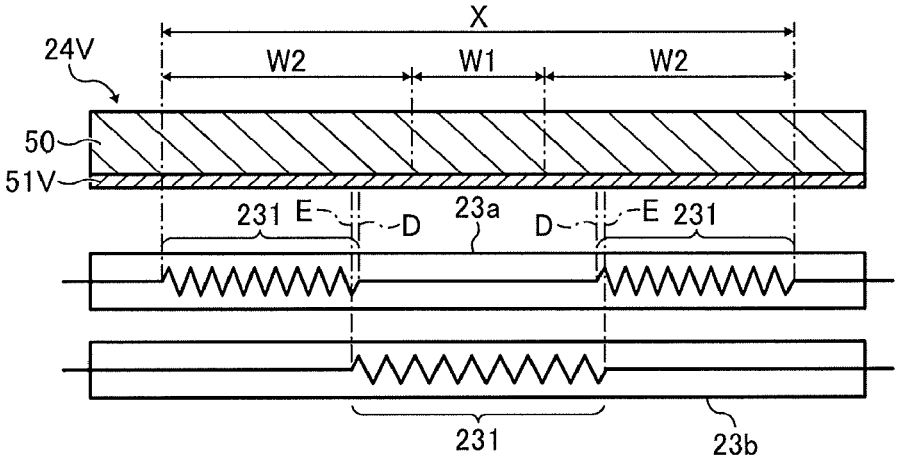
FIG. 14 is a cross-sectional view of a nip formation pad incorporating an increased thermal conductivity conductor as a first variation of the increased thermal conductivity conductor depicted in FIG. 12.

As illustrated in FIGS. 12 and 13, the increased thermal conductivity conductor 51U is disposed at a part of the nip formation pad 24U in the longitudinal direction thereof parallel to the width direction of the sheet P. Alternatively, the increased thermal conductivity conductor 51U may extend throughout the entire width of the nip formation pad 24U in the longitudinal direction thereof as illustrated in FIG. 14. FIG. 14 is a cross-sectional view of a nip formation pad 24V incorporating an increased thermal conductivity conductor 51V extending throughout the entire width of the nip formation pad 24V in a longitudinal direction thereof as a first variation of the increased thermal conductivity conductor 51U. The increased thermal conductivity conductor 51V facilitates heat conduction throughout the entire width of the fixing belt 21 in the axial direction thereof, evening the temperature of the outer circumferential surface of the fixing belt 21. Additionally, the increased thermal conductivity conductor 51V extending throughout the entire width of the nip formation pad 24V in the longitudinal direction thereof forms a flat nip formation face of the nip formation pad 24V that is disposed opposite the fixing nip N, thus preventing variation in pressure exerted to the fixing nip N.

FIG. 14 illustrates a conveyance span W1 where a small sheet P having a minimum width in the axial direction of the fixing belt 21 is conveyed over the fixing belt 21. FIG. 14 further illustrates a non-conveyance span W2 where the small sheet P is not conveyed over the fixing belt 21. The conveyance span W1 and the non-conveyance span W2 disposed at each lateral end span of the fixing belt 21 in the axial direction thereof constitute a heating span X where the lateral end heater 23*a* and the center heater 23*b* heat the fixing belt 21. When a plurality of small sheets P is conveyed through the fixing device 20S continuously, if the center heater 23*b* generates heat, the non-conveyance span W2 of the fixing belt 21 may suffer from gradual temperature increase or overheating because the small sheets P barely draw heat from the non-conveyance span W2 of the fixing belt 21. Such phenomenon is called a lateral end temperature increase. To address this circumstance, the increased thermal conductivity conductor 51V spans the entire non-conveyance span W2 in addition to the conveyance span W1 of the fixing belt 21 as illustrated in FIG. 14, facilitating heat conduction from the non-conveyance span W2 to the conveyance span W1 and thereby suppressing the lateral end temperature increase.

Figure 15:
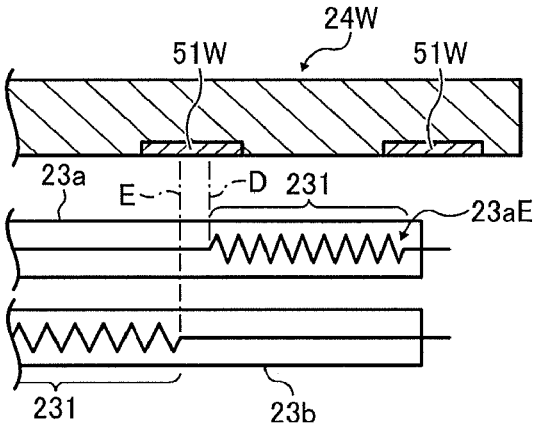
FIG. 15 is a cross-sectional view of a nip formation pad incorporating an increased thermal conductivity conductor as a second variation of the increased thermal conductivity conductor depicted in FIG. 12.

FIG. 15 is a cross-sectional view of a nip formation pad 24W incorporating an increased thermal conductivity conductor 51W as a second variation of the increased thermal conductivity conductor 51U. As illustrated in FIG. 15, two increased thermal conductivity conductors 51W span a part of the nip formation pad 24W in a longitudinal direction thereof. For example, a first increased thermal conductivity conductor 51W is disposed opposite the lateral ends D and E. A second increased thermal conductivity conductor 51W is disposed opposite an outboard end 23*a*E of the heat generator 231 of the lateral end heater 23*a* in the longitudinal direction thereof. The increased thermal conductivity conductors 51W suppress temperature decrease in the axial span between the lateral ends D and E on the fixing belt 21 in the axial direction thereof. Additionally, the increased thermal conductivity conductors 51W suppress temperature decrease in an axial span on the fixing belt 21 that is disposed opposite the outboard end 23*a*E of the heat generator 231 of the lateral end heater 23*a*.

A description is provided of variations of the nip formation pad 24V depicted in FIG. 14.

Figure 16:
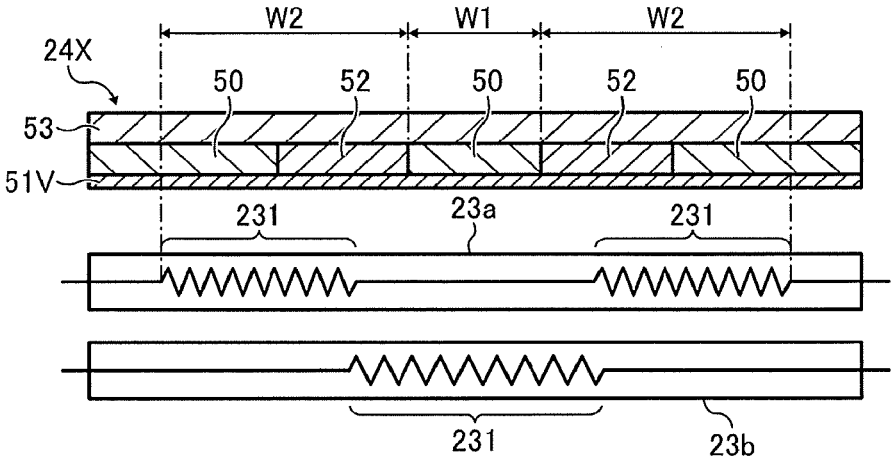
FIG. 16 is a cross-sectional view of a nip formation pad as a first variation of the nip formation pad depicted in FIG. 14.

FIG. 16 is a cross-sectional view of a nip formation pad 24X as a first variation of the nip formation pad 24V depicted in FIG. 14. As illustrated in FIG. 16, in addition to the increased thermal conductivity conductor 51V serving as a primary increased thermal conductivity conductor, the nip formation pad 24X includes a thermal absorber 52 serving as a secondary increased thermal conductivity conductor having a thermal conductivity greater than that of the base 50 and a thermal absorber 53 serving as a tertiary increased thermal conductivity conductor having a thermal conductivity greater than that of the base 50. Each of the thermal absorbers 52 and 53 is made of a material equivalent to the material of the increased thermal conductivity conductor 51 described above.

The thermal absorber 52 contacts an opposite face of the increased thermal conductivity conductor 51V that is opposite a fixing nip side face disposed opposite the fixing nip N. That is, the thermal absorber 52 is disposed opposite the fixing nip N via the increased thermal conductivity conductor 51V. The thermal absorber 52 is disposed at a part of the nip formation pad 24X in a longitudinal direction thereof parallel to the width direction of the sheet P. The base 50 abuts the thermal absorber 52 in the longitudinal direction of the nip formation pad 24X. For example, the thermal absorber 52 spans an inboard part of the non-conveyance span W2 where the small sheet P is not conveyed over the fixing belt 21. The inboard part abuts the conveyance span W1 because the inboard part is susceptible to the lateral end temperature increase when the small sheet P is conveyed over the fixing belt 21.

The thermal absorber 53 contacts an opposite face of an intermediate layer constructed of the thermal absorber 52 and the base 50 that is opposite a fixing nip side face of the intermediate layer that contacts the increased thermal conductivity conductor 51V. The thermal absorber 53 extends throughout the entire width of the nip formation pad 24X in the longitudinal direction thereof parallel to the width direction of the sheet P.

The thermal absorber 52 spans the inboard part of the non-conveyance span W2 where the fixing belt 21 is susceptible to the lateral end temperature increase when the small sheet P is conveyed over the fixing belt 21. Hence, even if the fixing belt 21 suffers from local temperature increase in the inboard part of the non-conveyance span W2, the thermal absorber 52 absorbs heat from the fixing belt 21, suppressing temperature increase of the fixing belt 21. Heat absorbed by the thermal absorber 52 is conducted to the thermal absorber 53. That is, each of the thermal absorbers 52 and 53 absorbs heat failed to be absorbed by the increased thermal conductivity conductor 51V and facilitates heat conduction in a thickness direction of the nip formation pad 24X. Each of the thermal absorbers 52 and 53 also conducts heat in a direction other than the thickness direction of the nip formation pad 24X. Since each of the thermal absorbers 52 and 53 has a predetermined width in the longitudinal direction of the nip formation pad 24X like the increased thermal conductivity conductor 51V, the thermal absorbers 52 and 53 conduct heat also in the longitudinal direction of the nip formation pad 24X. Similarly, the increased thermal conductivity conductor 51V conducts heat in the thickness direction as well as the longitudinal direction of the nip formation pad 24X.

As illustrated in FIG. 16, the thermal absorber 52 is disposed at a part of the nip formation pad 24X in the longitudinal direction thereof to suppress local temperature increase of the fixing belt 21 in the non-conveyance span W2. However, while the sheet P is conveyed over the thermal absorber 52, the thermal absorber 52 may absorb heat from the fixing belt 21 excessively, causing local temperature decrease.

Figure 17:
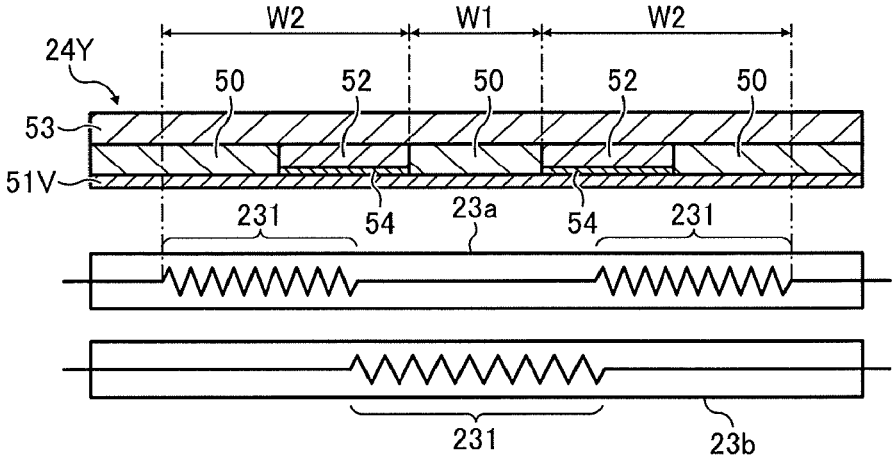
FIG. 17 is a cross-sectional view of a nip formation pad as a second variation of the nip formation pad depicted in FIG. 14.
Figure 18:
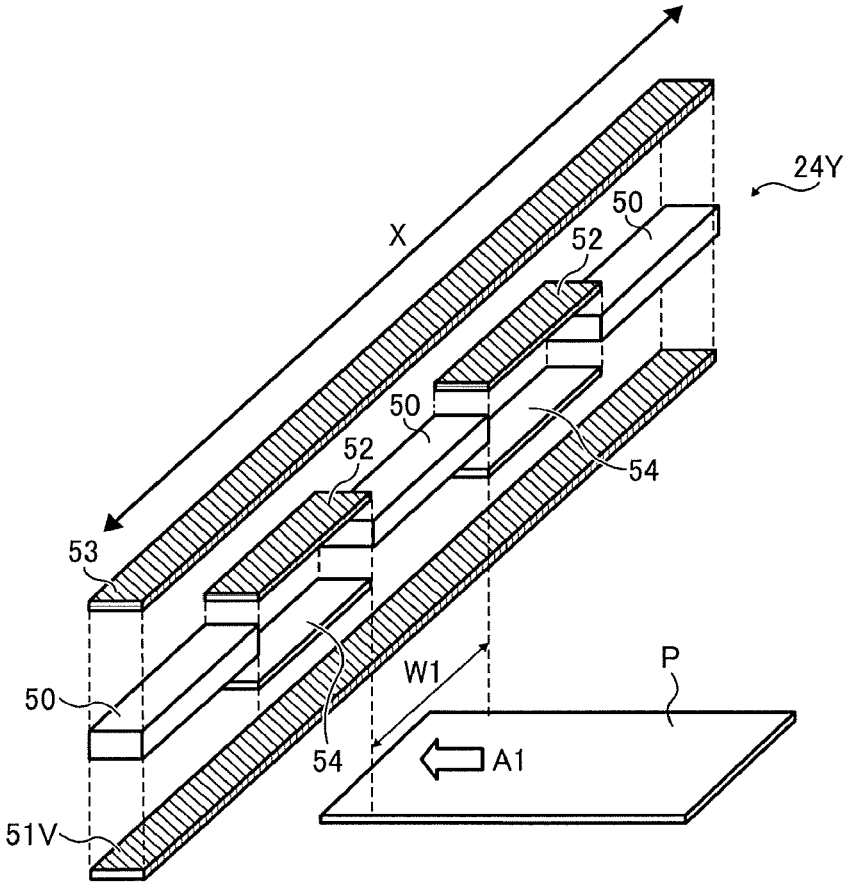
FIG. 18 is an exploded perspective view of the nip formation pad depicted in FIG. 17.

To address this circumstance, a resin layer 54 may be sandwiched between the thermal absorber 52 and the increased thermal conductivity conductor 51V as illustrated in FIGS. 17 and 18. FIG. 17 is a cross-sectional view of a nip formation pad 24Y as a second variation of the nip formation pad 24V depicted in FIG. 14. FIG. 18 is an exploded perspective view of the nip formation pad 24Y. As illustrated in FIGS. 17 and 18, the resin layer 54 having a thermal conductivity smaller than that of the thermal absorber 52 is interposed between the thermal absorber 52 and the increased thermal conductivity conductor 51V, reducing heat conduction from the increased thermal conductivity conductor 51V to the thermal absorber 52. Thus, the resin layer 54 suppresses local temperature decrease of the fixing belt 21 in the non-conveyance span W2. Since the nip formation pad 24Y depicted in FIGS. 17 and 18 has a construction similar to the construction of the nip formation pad 24X depicted in FIG. 16 except for the resin layer 54, a description of the similar construction is omitted.

Figure 19:
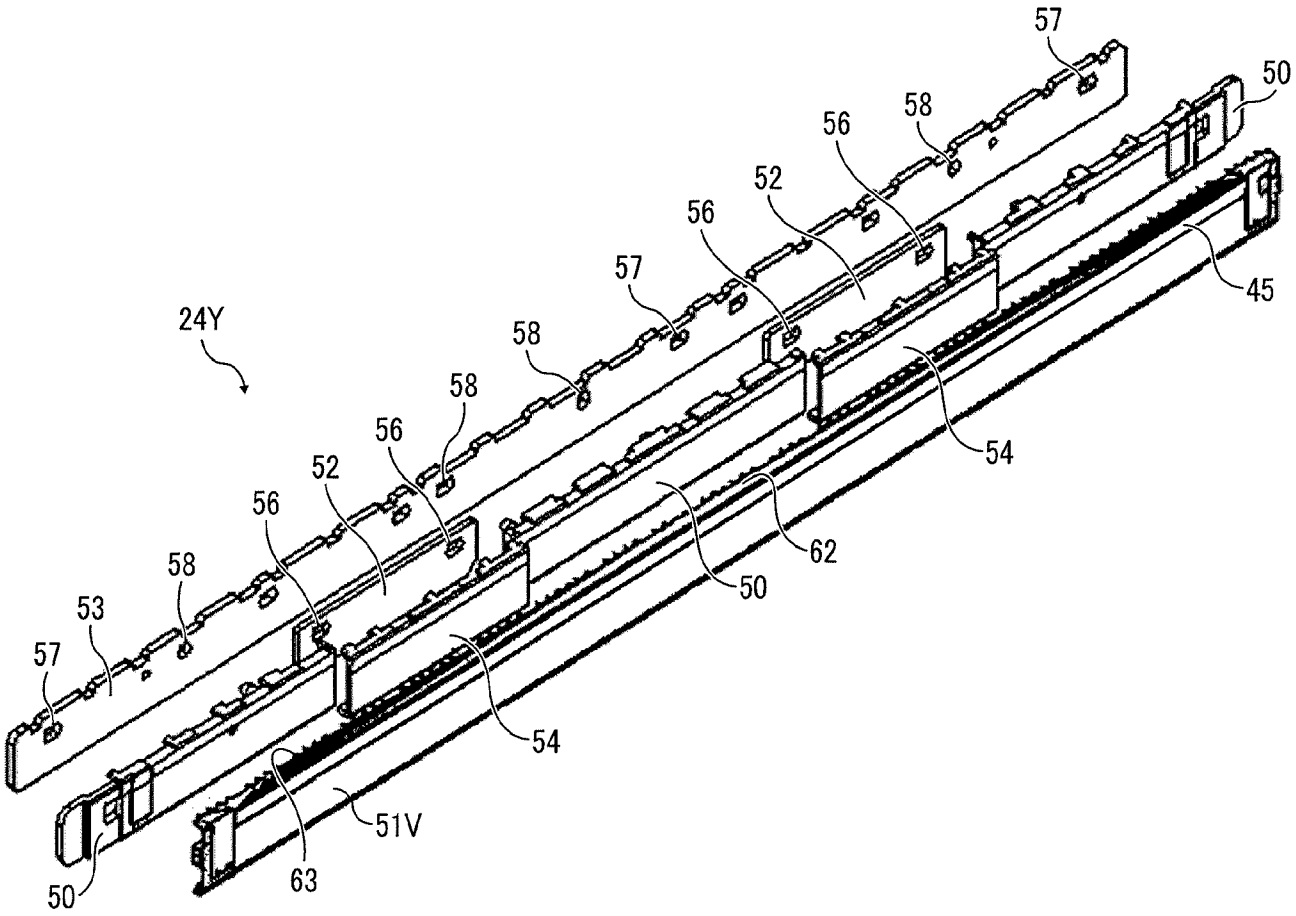
FIG. 19 is a schematic exploded perspective view of the nip formation pad depicted in FIG. 18 seen from a fixing nip of the fixing device depicted in FIG. 11.
Figure 20:
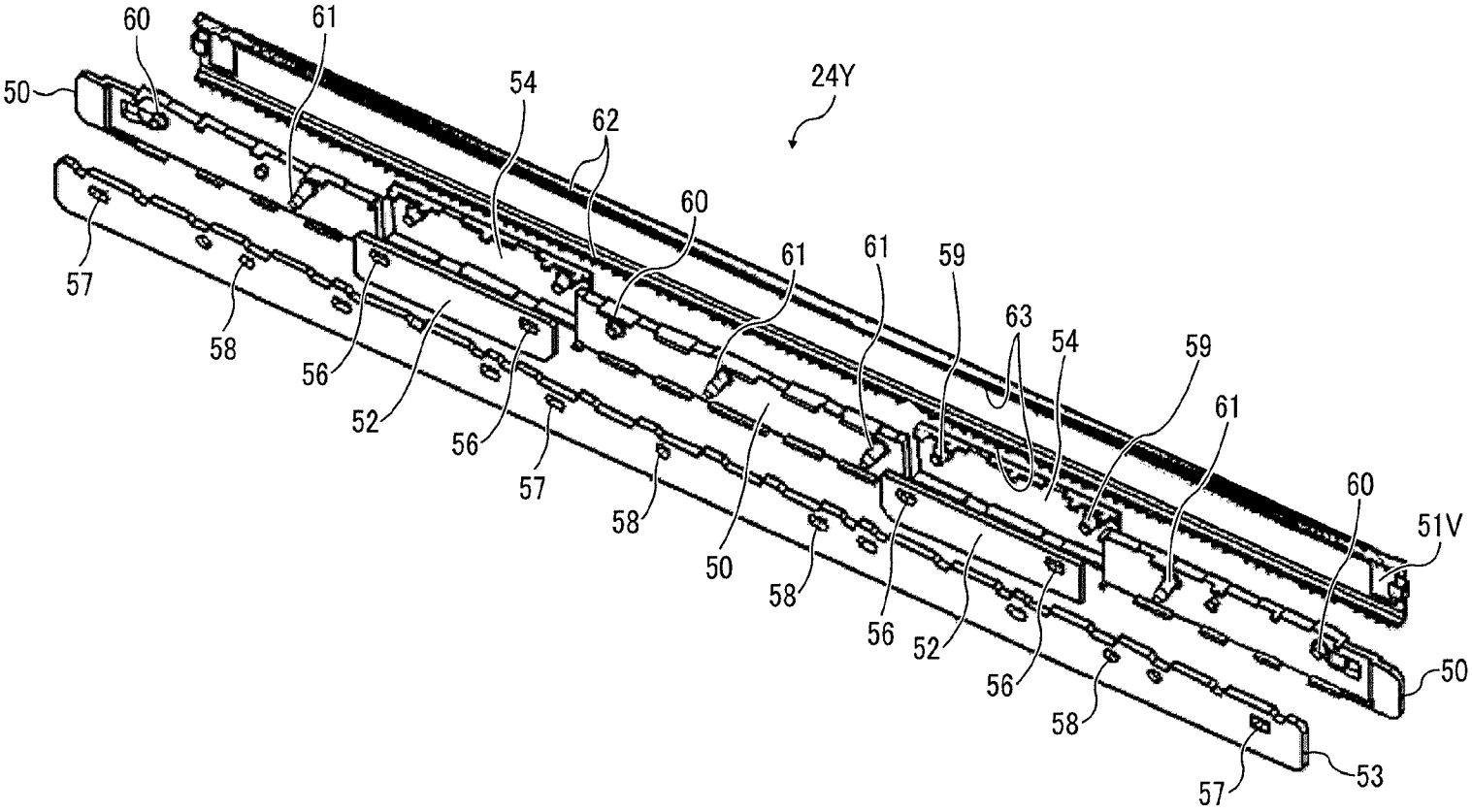
FIG. 20 is a schematic exploded perspective view of the nip formation pad depicted in FIG. 18 seen from a stay incorporated in the fixing device depicted in FIG. 11.

Referring to FIGS. 19 and 20, a detailed description is now given of a construction of the nip formation pad 24Y depicted in FIGS. 17 and 18.

FIG. 19 is a schematic exploded perspective view of the nip formation pad 24Y seen from the fixing nip N. FIG. 20 is a schematic exploded perspective view of the nip formation pad 24Y seen from the stay 25 depicted in FIG. 10.

As illustrated in FIGS. 19 and 20, an upstream end and a downstream end of the increased thermal conductivity conductor 51V in the sheet conveyance direction A1 are folded toward the stay 25 into a pair of rims 62, respectively, to contour the increased thermal conductivity conductor 51V into a U-shape in cross-section. Accordingly, the increased thermal conductivity conductor 51V with the pair of rims 62 accommodates the base 50, the resin layer 54, and the thermal absorbers 52 and 53 that are layered on the increased thermal conductivity conductor 51V. Since the increased thermal conductivity conductor 51V mounts the pair of rims 62, as the increased thermal conductivity conductor 51V receives a force directed in the rotation direction D21 of the fixing belt 21 while the fixing belt 21 slides over the increased thermal conductivity conductor 51V, the pair of rims 62 contacts the base 50 and the thermal absorber 53, restricting deviation of the increased thermal conductivity conductor 51V in the rotation direction D21 of the fixing belt 21.

As illustrated in FIG. 19, a plurality of through-holes 56 penetrates through the thermal absorber 52. A plurality of through-holes 57 and 58 penetrates through the thermal absorber 53. As illustrated in FIG. 20, a plurality of projections 61 projecting from an inner face of the base 50 toward the thermal absorber 53 is inserted into the plurality of through-holes 58, respectively. A plurality of projections 60 projecting from the inner face of the base 50 toward the thermal absorber 53 is inserted into the plurality of through-holes 57, respectively. A plurality of projections 59 projecting from an inner face of the resin layer 54 toward the thermal absorbers 52 and 53 is inserted into the plurality of through-holes 56, respectively. The projection 59 projecting from the resin layer 54 is inserted into the through-hole 56 penetrating through the thermal absorber 52 to hold the thermal absorber 52. The projections 60 and 61 projecting from the base 50 are inserted into the through-holes 57 and 58 penetrating through the thermal absorber 53, respectively, to hold the thermal absorber 53. The projection 61 projecting from the base 50 is longer than the projections 59 and 60 in a projection direction perpendicular to a longitudinal direction of the nip formation pad 24Y. Accordingly, the projection 61 penetrating through the through-hole 58 penetrating through the thermal absorber 53 engages an engagement hole of the stay 25, thus mounting or securing the entire nip formation pad 24Y on the stay 25.

Figure 21A:
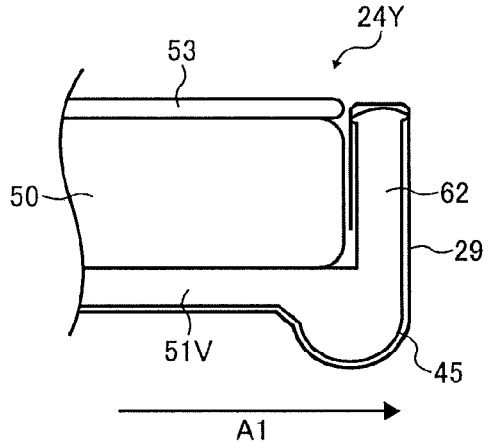
FIG. 21A is a partial cross-sectional view of the nip formation pad depicted in FIG. 20.
Figure 21B:
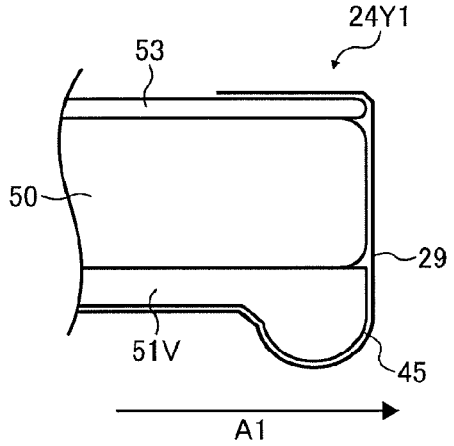
FIG. 21B is a partial cross-sectional view of a nip formation pad as a variation of the nip formation pad depicted in FIG. 21A.

FIG. 21 A is a partial cross-sectional view of the nip formation pad 24Y. As illustrated in FIG. 21A, the low-friction sheet 29 is sandwiched between the increased thermal conductivity conductor 51V and the fixing nip N. An end of the low-friction sheet 29 in the sheet conveyance direction A1 is wound around the rim 62 projecting from the increased thermal conductivity conductor 51V and is nipped and secured between the base 50 and the rim 62. FIG. 21B is a partial cross-sectional view of a nip formation pad 24Y1 as a variation of the nip formation pad 24Y depicted in FIG. 21A. As illustrated in FIG. 21B, the nip formation pad 24Y1 does not include the rim 62. In this case, the end of the low-friction sheet 29 in the sheet conveyance direction A1 is secured to the base 50 or the thermal absorber 53.

As illustrated in FIGS. 19 and 20, teeth 63 are mounted on an edge of each of the rims 62 that is directed to the stay 25. The teeth 63 partially extend on the rim 62 in the longitudinal direction of the nip formation pad 24Y. The teeth 63 precisely catch or engage the end of the low-friction sheet 29 depicted in FIG. 21A, preventing the low-friction sheet 29 from being displaced in the rotation direction D21 of the fixing belt 21 in accordance with rotation of the fixing belt 21. The rim 62 includes a plane abutted or interposed between the teeth 63. A jig used to attach the low-friction sheet 29 to the nip formation pad 24Y contacts the plane of the rim 62. As illustrated in FIGS. 19 and 20, the teeth 63 are mounted on each of the rims 62. Alternatively, the teeth 63 may be mounted on at least the upstream rim 62 in the sheet conveyance direction A1 to prevent the low-friction sheet 29 from being displaced in accordance with rotation of the fixing belt 21.

In the reference examples illustrated in FIGS. 17 to 20, 21A, and 21B, the resin layer 54 is interposed between the thermal absorber 52 and the increased thermal conductivity conductor 51V. Alternatively, a part of the base 50 may be interposed between the thermal absorber 52 and the increased thermal conductivity conductor 51V as illustrated in FIG. 22.

A description is provided of a construction of a nip formation pad 24Z as a third variation of the nip formation pad 24V depicted in FIG. 14.

Figure 22:
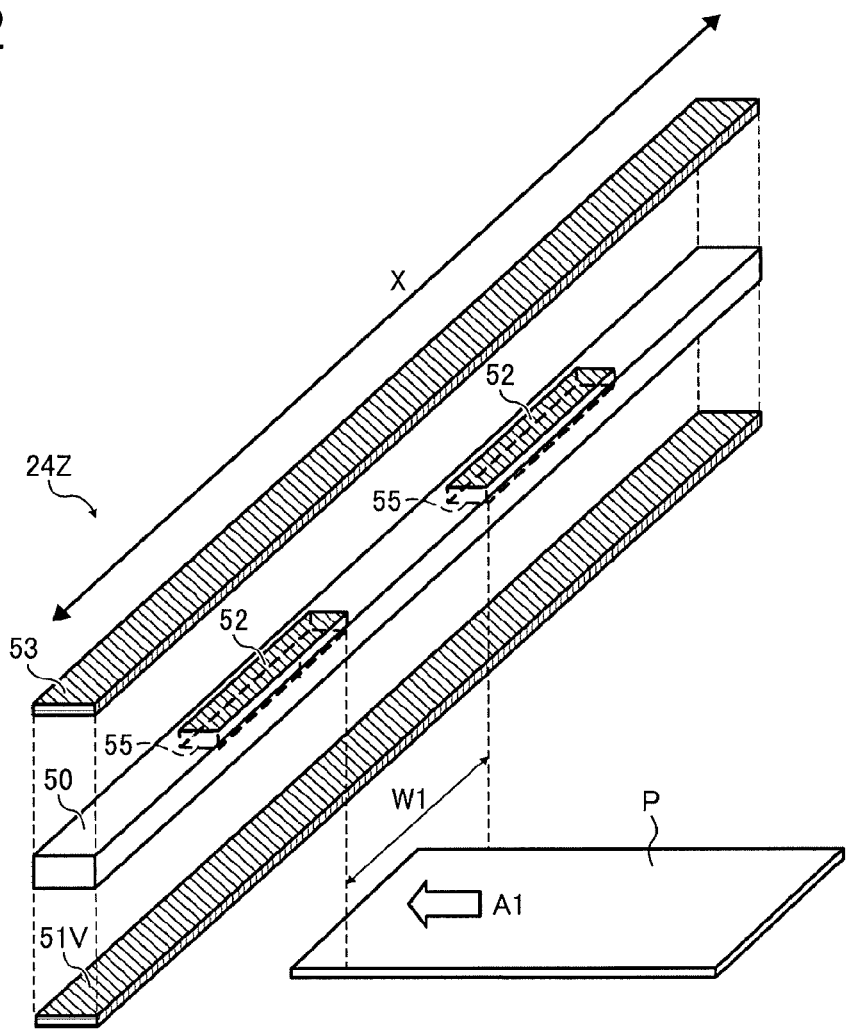
FIG. 22 is an exploded perspective view of a nip formation pad as a third variation of the nip formation pad depicted in FIG. 14.

FIG. 22 is an exploded perspective view of the nip formation pad 24Z. As illustrated in FIG. 22, the nip formation pad 24Z includes a recess 55 disposed in the base 50 and facing the thermal absorber 53. That is, the recess 55 does not face the increased thermal conductivity conductor 51V. The thermal absorber 52 is embedded in the recess 55. The recess 55 does not penetrate through the base 50 in a thickness direction of the nip formation pad 24Z. Hence, a part of the base 50 that constitutes a bottom of the recess 55 is interposed between the thermal absorber 52 and the increased thermal conductivity conductor 51V.

As described above, the base 50 serving as a decreased thermal conductivity conductor is interposed between the thermal absorber 52 and the increased thermal conductivity conductor 51V. Accordingly, like the nip formation pad 24Y incorporating the resin layer 54 as illustrated in FIG. 18, the base 50 reduces heat conduction from the increased thermal conductivity conductor 51V to the thermal absorber 52. For example, in the reference example illustrated in FIGS. 17 to 20, 21A, and 21B, the resin layer 54 separately provided from the base 50 serves as a decreased thermal conductivity conductor interposed between the thermal absorber 52 and the increased thermal conductivity conductor 51V. Conversely, as illustrated in FIG. 22, the base 50 serves as a decreased thermal conductivity conductor interposed between the thermal absorber 52 and the increased thermal conductivity conductor 51V. The thickness (e.g., the depth) and the length in the sheet conveyance direction A1 of the recess 55 are changed properly to adjust an amount of heat conducted from the increased thermal conductivity conductor 51V to the thermal absorber 52. For example, the thickness of the recess 55 is decreased or the length of the recess 55 in the sheet conveyance direction A1 is increased to allow the thermal absorber 52 to absorb an increased amount of heat.

The reference examples described above may be modified. For example, according to the reference examples illustrated in FIGS. 16 to 20, 21A, 21B, and 22, the increased thermal conductivity conductor 51V spans the entire width of the nip formation pad (e.g., the nip formation pads 24X, 24Y, 24Y1, and 24Z) in the longitudinal direction thereof. Alternatively, like the increased thermal conductivity conductor 51U illustrated in FIG. 12, the increased thermal conductivity conductor 51V may be disposed opposite the inboard end D of the heat generator 231 of the lateral end heater 23*a* and the outboard end E of the heat generator 231 of the center heater 23*b*.

A description is provided of advantages of the fixing devices 20 and 20S.

As illustrated in FIGS. 2 and 10, each of the fixing devices 20 and 20S includes a fixing rotator or an endless belt (e.g., the fixing belt 21), a primary heater (e.g., the center heater 23*b*), a secondary heater (e.g., the lateral end heater 23*a*), a nip formation pad (e.g., the nip formation pads 24, 24U, 24V, 24W, 24X, 24Y, 24Y1, and 24Z), an opposed rotator (e.g., the pressure roller 22), and a temperature detector (e.g., the temperature sensors 27 and 27S). The endless belt is rotatable in a predetermined direction of rotation (e.g., the rotation direction D21).

As illustrated in FIG. 6, the primary heater includes a center heat generator (e.g., the heat generator 231) disposed opposite a center span of the endless belt in an axial direction thereof or a primary heat generator (e.g., the heat generator 231) disposed opposite the endless belt. The secondary heater includes a lateral end heat generator (e.g., the heat generator 231) disposed opposite a lateral end span of the endless belt in the axial direction thereof or a secondary heat generator (e.g., the heat generator 231) disposed opposite the endless belt and disposed outboard from the primary heat generator in the axial direction of the endless belt.

As illustrated in FIGS. 2 and 10, the nip formation pad is disposed opposite an inner circumferential surface of the endless belt. The opposed rotator is disposed opposite an outer circumferential surface of the endless belt and pressed against the nip formation pad via the endless belt to form the fixing nip N between the endless belt and the opposed rotator, through which a recording medium (e.g., a sheet P) bearing a toner image (e.g., a toner image T) is conveyed. The temperature detector is disposed opposite the lateral end heat generator or the secondary heat generator of the secondary heater to detect a temperature of the endless belt. The temperature detector has the detection span S in the axial direction of the endless belt.

As illustrated in FIGS. 6 to 9, 12 to 20, 21A, 21B, and 22, the nip formation pad includes a base (e.g., the base 50) and an increased thermal conductivity conductor (e.g., the increased thermal conductivity conductors 51, 51S, 51T, 51U, and 51V) interposed between the base and the fixing nip N and having a thermal conductivity greater than a thermal conductivity of the base.

As illustrated in FIG. 6, the secondary heat generator includes the inboard edge 231 in and an outboard edge 231 out disposed outboard from the inboard edge 231 in in the axial direction of the endless belt. The inboard edge 231 in is disposed opposite the center span of the endless belt. The outboard edge 231 out is disposed opposite the lateral end span of the endless belt. The secondary heat generator has an inboard length (e.g., the length Lb) defined between the center g of the detection span S of the temperature detector and the inboard edge 231 in in the axial direction of the endless belt. The secondary heat generator has an outboard length (e.g., the length La) defined between the center g of the detection span S of the temperature detector and the outboard edge 231 out in the axial direction of the endless belt. The secondary heat generator defines a ratio of the outboard length to the inboard length that is greater than 7/3.

According to the exemplary embodiments described above, the nip formation pad includes the increased thermal conductivity conductor that enlarges the detection span S of the temperature detector substantially. Consequently, the temperature detector is disposed relative to the secondary heat generator such that the secondary heat generator defines the ratio of the outboard length to the inboard length that is greater than 7/3.

According to the exemplary embodiments described above, the fixing belt 21 serves as an endless belt. Alternatively, a fixing film, a fixing sleeve, or the like may be used as an endless belt. Further, the pressure roller 22 serves as an opposed rotator. Alternatively, a pressure belt or the like may be used as an opposed rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

an endless belt rotatable in a predetermined direction of rotation;

a nip formation pad disposed opposite an inner circumferential surface of the endless belt, the nip formation pad including:

a base; and an increased thermal conductivity conductor being interposed between the base and the endless belt and having a thermal conductivity increased relative to a thermal conductivity of the base;

an opposed rotator to press against the nip formation pad via the endless belt to form a fixing nip between the endless belt and the opposed rotator, the fixing nip through which a recording medium bearing a toner image is conveyed;

a primary heat generator disposed opposite the endless belt;

a secondary heat generator disposed opposite the endless belt and disposed outboard from the primary heat generator in an axial direction of the endless belt;

a primary temperature detector to detect a temperature of the endless belt; and a secondary temperature detector, disposed opposite the secondary heat generator and disposed outboard from the primary temperature detector in the axial direction of the endless belt, to detect the temperature of the endless belt, the secondary temperature detector having a detection span in the axial direction of the endless belt, the secondary heat generator including:

an inboard edge; and an outboard edge disposed outboard from the inboard edge in the axial direction of the endless belt, the secondary heat generator having an inboard length defined between a center of the detection span of the secondary temperature detector and the inboard edge in the axial direction of the endless belt, the secondary heat generator further having an outboard length defined between the center of the detection span of the secondary temperature detector and the outboard edge in the axial direction of the endless belt, the secondary heat generator defining a ratio of the outboard length to the inboard length that is greater than 7/3, wherein the secondary temperature detector is a most outboard temperature detector in the axial direction of the endless belt.

2. The fixing device according to claim 1, wherein the ratio of the outboard length to the inboard length is smaller than 10/3 and greater than 7/3.

3. The fixing device according to claim 1, wherein a lateral edge of a conveyance span where a wide recording medium having a larger width in the axial direction of the endless belt than said recording medium is conveyed over the endless belt is outboard from the center of the detection span of the secondary temperature detector and inboard from the outboard edge of the secondary heat generator in the axial direction of the endless belt.

4. The fixing device according to claim 3, wherein the conveyance span has a width greater than 297 mm in the axial direction of the endless belt.

5. The fixing device according to claim 1, wherein the secondary heat generator has a width greater than 51.5 mm in the axial direction of the endless belt.

6. The fixing device according to claim 1, wherein the increased thermal conductivity conductor has a thermal conductivity not smaller than 236 W/mK.

7. The fixing device according to claim 1, wherein the primary heat generator is disposed opposite a center span of the endless belt in the axial direction of the endless belt, and wherein the secondary heat generator is disposed opposite each lateral end span of the endless belt in the axial direction of the endless belt.

8. The fixing device according to claim 1, wherein the increased thermal conductivity conductor spans from a lateral edge of a conveyance span where a wide recording medium, having a larger width in the axial direction of the endless belt than said recording medium is conveyed over the endless belt to the detection span of the secondary temperature detector in the axial direction of the endless belt such that the increased thermal conductivity conductor overlaps the detection span of the secondary temperature detector.

9. The fixing device according to claim 1, wherein the primary heat generator includes an outboard end disposed opposite the secondary heat generator, wherein the secondary heat generator includes an inboard end disposed opposite the primary heat generator, and wherein the increased thermal conductivity conductor is disposed opposite the outboard end of the primary heat generator and the inboard end of the secondary heat generator.

10. The fixing device according to claim 9, further comprising another increased thermal conductivity conductor being interposed between the base and the endless belt and having a thermal conductivity greater than the thermal conductivity of the base, wherein the secondary heat generator further includes an outboard end disposed outboard from the inboard end in the axial direction of the endless belt and disposed opposite the another increased thermal conductivity conductor.

11. The fixing device according to claim 1, wherein the increased thermal conductivity conductor extends throughout an entire width of the nip formation pad in a longitudinal direction of the nip formation pad.

12. A fixing device comprising:

an endless belt rotatable in a predetermined direction of rotation;

a nip formation pad disposed opposite an inner circumferential surface of the endless belt, the nip formation pad including:

a base; and an increased thermal conductivity conductor being interposed between the base and the endless belt and having a thermal conductivity increased relative to a thermal conductivity of the base;

an opposed rotator to press against the nip formation pad via the endless belt to form a fixing nip between the endless belt and the opposed rotator, the fixing nip through which a recording medium bearing a toner image is conveyed;

a primary heat generator disposed opposite the endless belt;

a secondary heat generator disposed opposite the endless belt and disposed outboard from the primary heat generator in an axial direction of the endless belt;

a primary temperature detector to detect a temperature of the endless belt; and a secondary temperature detector, disposed opposite the secondary heat generator and disposed outboard from the primary temperature detector in the axial direction of the endless belt, to detect the temperature of the endless belt, the secondary heat generator including:

an inboard edge; and an outboard edge disposed outboard from the inboard edge in the axial direction of the endless belt, the secondary heat generator having an inboard length defined between a center of the secondary temperature detector and the inboard edge in the axial direction of the endless belt, the secondary heat generator further having an outboard length defined between the center of the secondary temperature detector and the outboard edge in the axial direction of the endless belt, the secondary heat generator defining a ratio of the outboard length to the inboard length that is greater than 7/3, wherein the secondary temperature detector is a most outboard temperature detector in the axial direction of the endless belt.

13. The fixing device according to claim 12, wherein the ratio of the outboard length to the inboard length is smaller than 10/3 and greater than 7/3.

14. The fixing device according to claim 12, wherein an outboard edge of a conveyance span where a wide recording medium having a larger width in the axial direction of the endless belt than said recording medium is conveyed over the endless belt is outboard from the center of the secondary temperature detector and inboard from the outboard edge of the secondary heat generator in the axial direction of the endless belt.

15. The fixing device according to claim 14, wherein the conveyance span has a width greater than 297 mm in the axial direction of the endless belt.

16. The fixing device according to claim 12, wherein the secondary heat generator has a width greater than 51.5 mm in the axial direction of the endless belt.

17. The fixing device according to claim 12, wherein the increased thermal conductivity conductor has a thermal conductivity not smaller than 236 W/mK.

18. An image forming apparatus comprising:

an image forming device to form a toner image; and a fixing device, disposed downstream from the image forming device in a recording medium conveyance direction, to fix the toner image on a recording medium, the fixing device including:

an endless belt rotatable in a predetermined direction of rotation;

a nip formation pad disposed opposite an inner circumferential surface of the endless belt, the nip formation pad including:

a base; and an increased thermal conductivity conductor being interposed between the base and the endless belt and having a thermal conductivity increased relative to a thermal conductivity of the base;

an opposed rotator to press against the nip formation pad via the endless belt to form a fixing nip between the endless belt and the opposed rotator, the fixing nip through which the recording medium bearing the toner image is conveyed;

a primary heat generator disposed opposite the endless belt;

a secondary heat generator disposed opposite the endless belt and disposed outboard from the primary heat generator in an axial direction of the endless belt;

a primary temperature detector to detect a temperature of the endless belt; and a secondary temperature detector, disposed opposite the secondary heat generator and disposed outboard from the primary temperature detector in the axial direction of the endless belt, to detect the temperature of the endless belt, the secondary temperature detector having a detection span in the axial direction of the endless belt, the secondary heat generator including:

an inboard edge; and an outboard edge disposed outboard from the inboard edge in the axial direction of the endless belt, the secondary heat generator having an inboard length defined between a center of the detection span of the secondary temperature detector and the inboard edge in the axial direction of the endless belt, the secondary heat generator further having an outboard length defined between the center of the detection span of the secondary temperature detector and the outboard edge in the axial direction of the endless belt, the secondary heat generator defining a ratio of the outboard length to the inboard length that is greater than 7/3, wherein the secondary temperature detector is a most outboard temperature detector in the axial direction of the endless belt.

* * * * *